US009594332B2

(12) United States Patent
Kadota et al.

(10) Patent No.: US 9,594,332 B2
(45) Date of Patent: Mar. 14, 2017

(54) DEVELOPING DEVICE AND IMAGE FORMING APPARATUS AND PROCESS CARTRIDGE INCORPORATING SAME

(71) Applicants: Ichiro Kadota, Kanagawa (JP); Yuuji Ishikura, Kanagawa (JP)

(72) Inventors: Ichiro Kadota, Kanagawa (JP); Yuuji Ishikura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/822,279

(22) Filed: Aug. 10, 2015

(65) Prior Publication Data

US 2016/0062274 A1 Mar. 3, 2016

(30) Foreign Application Priority Data

Aug. 29, 2014 (JP) ..... 2014-176009

(51) Int. Cl.
*G03G 15/08* (2006.01)
*G03G 15/09* (2006.01)

(52) U.S. Cl.
CPC ..... *G03G 15/0891* (2013.01); *G03G 15/0808* (2013.01)

(58) Field of Classification Search
CPC ..... G03G 15/0812; G03G 15/0818; G03G 15/0819; G03G 15/0891; G03G 15/0808
See application file for complete search history.

(56) References Cited

U.S. PATENT DOCUMENTS 6,284,424 B1 9/2001 Iimura et al.
2002/0064408 A1 5/2002 Akiba et al.
2003/0035663 A1 2/2003 Oyama et al.
2004/0096244 A1 5/2004 Kadota et al.
2006/0072943 A1 4/2006 Suzuki et al.
2007/0098449 A1 5/2007 Kadota et al.
2007/0160395 A1 7/2007 Kosugi et al.
2009/0022523 A1 1/2009 Kadota et al.
2009/0311004 A1* 12/2009 Naruse ..... G03G 15/161 399/101
2010/0021214 A1 1/2010 Kadota et al.
2010/0054800 A1* 3/2010 Okabe ..... G03G 21/1832 399/114
2010/0226690 A1 9/2010 Kadota et al.
2011/0176820 A1 7/2011 Kadota et al.
2012/0057891 A1 3/2012 Ishikura et al.
2012/0163874 A1 6/2012 Hattori et al.
2012/0321352 A1* 12/2012 Iida ..... G03G 15/0893 399/254
2013/0071148 A1 3/2013 Ishikura et al.
2013/0243499 A1 9/2013 Ishikura et al.

FOREIGN PATENT DOCUMENTS

JP 11-064212 3/1999
JP 2002-229390 8/2002
JP 2007-101927 4/2007
JP 2007-140573 6/2007
JP 2011-027904 2/2011
JP 2012-133212 7/2012

* cited by examiner

*Primary Examiner* — David Gray
*Assistant Examiner* — Michael Harrison
(74) *Attorney, Agent, or Firm* — Oblon, McClelland, Maier & Neustadt, L.L.P.

(57) ABSTRACT

A developing device includes a casing to contain developer and a developer bearer disposed in the casing to bear developer, and a rough face repellent to developer is disposed inside the casing.

18 Claims, 23 Drawing Sheets

DEVELOPING DEVICE AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. §119(a) to Japanese Patent Application No. 2014-176009, filed on Aug. 29, 2014, in the Japan Patent Office, the entire disclosure of which is hereby incorporated by reference herein.

BACKGROUND

Technical Field

Embodiments of the present invention generally relate to a developing device, a process cartridge, and an image forming apparatus, such as a copier, a printer, a facsimile machine, or a multifunction peripheral having at least two of copying, printing, facsimile transmission, plotting, and scanning capabilities.

Description of the Related Art

Electrophotographic image forming apparatuses, such as copiers and printers, form visible images with developer on an image bearer, such as a photoconductor and an intermediate transfer member, and transfer the images onto sheets of recording media. A certain amount of developer remains untransferred on image bearer and collected by a cleaning device. There are image forming apparatuses configured to return the developer collected by the cleaning device through a collected-developer passage to a developing device.

Although use of developer having lower melting point is promoted to reduce impact on environment, it is possible that such developer solidifies or adheres inside the developing device or the collected-developer passage (e.g., a collected-developer tube) due to temperature rise at the start of the apparatus and degradation of developer over time. When the apparatus is left unused under hot and humid conditions, the possibility of adhesion of developer also arises. When an impact such as vibration is given to the solidified developer in the collected-developer passage, there is a risk that the developer falls and is transported to the developing device, causing image failure.

SUMMARY

An embodiment of the present invention provides a developing device that includes a casing to contain developer, a rough face repellent to developer, disposed inside the casing, and a developer bearer disposed in the casing to bear developer.

Another embodiment provides a process cartridge that is removably installable in an image forming apparatus and includes the above-described developing device and at least one of an image bearer, a charging device to charge the image bearer, and a cleaning device to clean the image bearer.

Yet another embodiment provides an image forming apparatus that includes the above-described process cartridge.

Yet another embodiment provides an image forming apparatus that includes the above-described developing device.

Yet another embodiment provides an image forming apparatus that includes an image bearer to bear a latent image, a developing device to develop the latent image with developer, a cleaning device to collect developer from the image bearer; and a developer collecting device to return the developer collected by the cleaning device to the developing device. A rough face repellent to developer is disposed inside the developer collecting device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
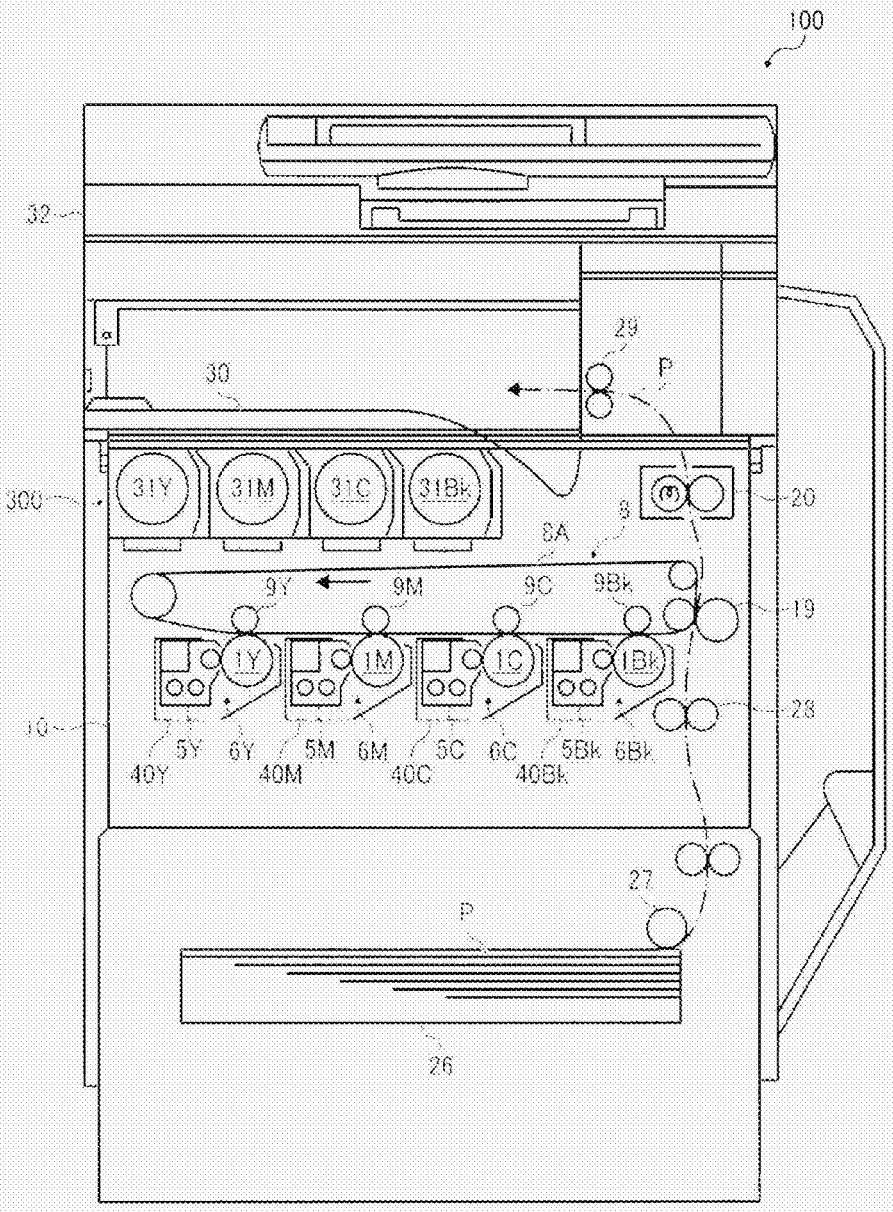
FIG. 1 is a schematic view of an image forming apparatus including a developing device and a process cartridge according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, developing devices according to a first embodiment and variations thereof and image forming apparatuses that incorporate such developing devices, are described below.

The first embodiment and variations thereof relate to developing devices provided with a portion or a component repellent to developer, attained by a surface roughness structure. Each of the multiple developing devices described below is removably mounted in the image forming apparatus, either independently or as a part of a process cartridge.

It is to be noted that the suffixes Y, M, C, and Bk attached to each reference numeral indicate only that components indicated thereby are used for forming yellow, magenta, cyan, and black images, respectively, and hereinafter may be omitted when color discrimination is not necessary.

The configuration illustrated in FIG. 1 represents image forming apparatuses to which any of the developing devices and the process cartridges described below is mounted. In the variations, descriptions of components similar to those of the first embodiment are omitted.

FIG. 1 is a schematic view of an image forming apparatus 100 that employs a process cartridge including a developing device according to the first embodiment.

In FIG. 1, reference numeral 10 represents an apparatus body of the image forming apparatus 100 that in the present embodiment is, for example, a tandem-type multicolor copier, 32 represents a document reader that reads image data of a document and includes a document feeder to transport the document, 30 represents an output tray on which output images are stacked, 26 represents a sheet feeding tray containing sheets P of recording media, 27 represents sheet feeding rollers to feed the sheets P one by one from the sheet feeding tray 26, and 28 represents a registration roller pair to adjust the timing to transport the sheet P.

Further, reference characters 6Y, 6M, 6C, and 6Bk respectively represent yellow, magenta, cyan, and black image forming units, 1Y, 1M, 1C, and 1Bk represent photoconductor drums (i.e., image bearers) for respective colors, 5Y, 5M, 5C, and 5Bk represent developing devices to develop electrostatic latent images on the photoconductor drums 1Y, 1M, 1C, and 1Bk, 9Y, 9M, 9C, and 9Bk represent primary transfer bias rollers to transfer toner images from the photoconductor drums 1Y, 1M, 1C, and 1Bk.

Reference characters 8 represent an intermediate transfer unit including an intermediate transfer belt 8A, serving as an image bearer on which multiple single-color toner images are superimposed one on another, 19 represents a secondary transfer bias roller to transfer the superimposed toner image from the intermediate transfer belt 8A onto the sheet P, 20 represents a fixing device to fix the toner image on the sheet P, and 300 represents a bottle mount section to contain toner containers 31Y, 31M, 31C, and 31Bk from which respective color toners are supplied to the developing devices 5.

Figure 2:
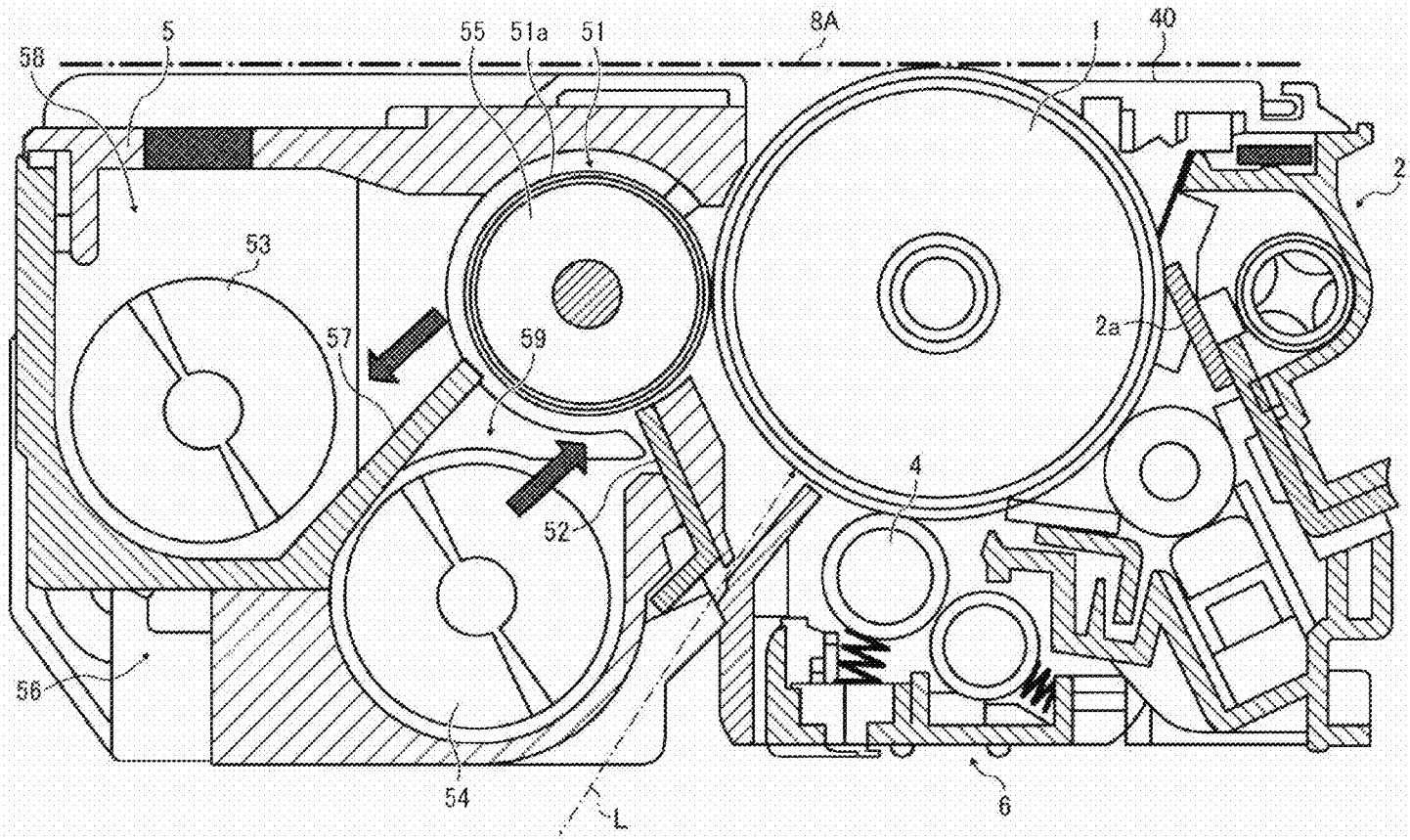
FIG. 2 illustrates a process cartridge according to an embodiment.

As illustrated in FIG. 1, the intermediate transfer unit 8 is disposed in the apparatus body 10. The image forming units 6Y, 6M, 6C, and 6Bk respectively corresponding to yellow, magenta, cyan, and black are arranged in parallel, facing the intermediate transfer belt 8A of the intermediate transfer unit 8. The image forming units 6Y, 6M, 6C, and 6Bk have a similar configuration, an example of which is illustrated in FIG. 2, except the color of the toner (yellow, magenta, cyan, or black) used in electrophotographic image formation. In FIG. 2, the reference character representing the color (Y, M, C, or K) is omitted from the image forming unit 6, the photoconductor drum 1, and the primary transfer bias roller 9.

Referring to FIG. 2, the image forming unit 6 includes a photoconductor drum 1 and further includes a charging device 4, the developing device 5, a cleaning device 2, and the like provided around the photoconductor drum 1 (only the developing device 5 is illustrated in FIG. 1). In the image forming unit 6, toner images are formed on the photoconductor drum 1 through image forming processes, namely, charging, exposure, developing, transfer, and cleaning processes.

The components of the image forming unit 6, namely, the photoconductor drum 1, the charging device 4, the developing device 5, and the cleaning device 2 are united together into a process cartridge and, for example, held by a cartridge casing 40. The image forming unit 6 configured as the process cartridge is removably mounted in the apparatus body 10 and replaced when its operational life expires. It is to be noted that, in FIG. 1, the reference characters representing the colors are given to the cartridge casings 40 (40Y, 40M, 40C, and 40Bk). Alternatively, the developing device 5 and at least one of the photoconductor drum 1, the charging device 4, and a cleaning device 2 are united together into a process cartridge.

When the image forming unit 6 is configured as the process cartridge removably mountable in the apparatus body 10, maintenance work and replacement of the image forming unit 6 can be facilitated, and recycling thereof can improve.

Operations of the image forming apparatus 100 illustrated in FIG. 1 to form multicolor images are described below. It is to be noted that FIG. 2 is also referred to describe image forming process performed on the respective photoconductor drums 1 of the image forming unit 6Y, 6M, 6C, and 6Bk.

Conveyance rollers of the document feeder transport documents set on a document table onto an exposure glass (contact glass) of the document reader 32. Then, the document reader 32 reads image data of the document set on the exposure glass optically.

More specifically, the document reader 32 scans the image of the document with light emitted from an illumination lamp. The light reflected from the surface of the document is imaged on a color sensor via mirrors and lenses. The multicolor image data of the original is decomposed into red, green, and blue (RGB), read by the color sensor, and converted into electrical image signals. Further, the image signals are transmitted to an image processor that performs image processing (e.g., color conversion, color calibration, and spatial frequency adjustment) according to the image signals, and thus image data of yellow, magenta, cyan, and black is obtained.

Then, the image data of yellow, magenta, cyan, and black are transmitted to an exposure section including an optical writing device. The optical writing device directs laser beams L (see FIG. 2) to the photoconductor drums 1Y, 1M, 1C, and 1Bk according to the image data of respective colors.

Meanwhile, the four photoconductor drums 1Y, 1M, 1C, and 1Bk rotate clockwise in FIG. 1. Initially, the surface of each photoconductor drum 1 is charged by the charging device 4 (illustrated in FIG. 2) uniformly at a position facing the charging device 4 (a charging process). Thus, the surface of the photoconductor drum 1 is charged to a predetermined electrical potential. When the photoconductor drum 1 reaches a portion to receive the laser beam L from the exposure section, the photoconductor drum 1 is scanned with the laser beam L, and thus an electrostatic latent image is formed thereon (an exposure process).

More specifically, the laser beams L according to the respective color image data are emitted from four light sources of the exposure section. The four laser beams L pass through different optical paths for yellow, magenta, cyan, and black.

The laser beam L corresponding to the yellow component is directed to the photoconductor drum 1Y, which is the first from the left in FIG. 1 among the four photoconductor drums 1. A polygon mirror that rotates at high velocity deflects the laser beam L for yellow in a direction of a rotation axis of the photoconductor drum 1Y (main scanning direction) so that the laser beam L scans the surface of the photoconductor drum 1Y. Thus, an electrostatic latent image for yellow is formed on the photoconductor drum 1Y charged by the charging device 4.

Similarly, the laser beam L corresponding to the magenta component is directed to the surface of the photoconductor drum 1M that is the second from the left in FIG. 1, thus forming an electrostatic latent image for magenta thereon.

The laser beam L corresponding to the cyan component is directed to the surface of the photoconductor drum 1C that is the third from the left in FIG. 1, thus forming an electrostatic latent image for cyan thereon.

The laser beam L corresponding to the black component is directed to the surface of the photoconductor drum 1Bk that is the fourth from the left in FIG. 1, thus forming an electrostatic latent image for black thereon.

Subsequently, the surfaces of the photoconductor drums 1Y, 1M, 1C, and 1Bk where the electrostatic latent image are formed are further transported to the positions facing the developing devices 5Y, 5M, 5C, and 5Bk. The developing devices 5Y, 5M, 5C, and 5Bk supply toner of the corresponding color to the photoconductor drums 1Y, 1M, 1C, and 1Bk. Thus, the latent images on the respective photoconductor drums 1Y, 1M, 1C, and 1Bk are developed into different single-color toner images in a development process.

Subsequently, the surfaces of the photoconductor drums 1Y, 1M, 1C, and 1Bk reach positions facing the intermediate transfer belt 8A, serving as the image bearer as well as an intermediate transfer member. At the positions facing the photoconductor drums 1, the primary transfer bias rollers 9 are disposed to contact or abut an inner circumferential face of the intermediate transfer belt 8A. At these positions, the toner images on the photoconductor drums 1Y, 1M, 1C, and 1Bk are sequentially transferred and superimposed one on another, into a multicolor toner image, on the intermediate transfer belt 8A (a primary transfer process). After the primary transfer process, a certain amount of toner tends to remain untransferred on each photoconductor drum 1.

Subsequently, the surface of the photoconductor drum 1 reaches a position facing the cleaning device 2 (illustrated in FIG. 2). In the cleaning device 2, a cleaning blade 2*a* or the like collects the untransferred toner from the photoconductor drum 1 (a cleaning process). Subsequently, a discharger removes potentials remaining on the surface of the photoconductor drum 1. Thus, a sequence of image forming processes performed on each photoconductor drum 1 is completed.

The image forming units 6 illustrated in FIG. 1 perform the above-described image forming processes, respectively. That is, referring to FIG. 1, from the exposure section disposed below the image forming units 6 in FIG. 1, the laser beams L are directed according to image data onto the respective photoconductor drums 1 in the image forming units 6. Specifically, the exposure section includes light sources to emit the laser beams L, multiple optical elements, and a polygon mirror that is rotated by a motor. The laser beams L are directed to the respective photoconductor drums 1 via the multiple optical elements while being deflected by the polygon mirror. Then, the toner images formed on the respective photoconductor drums 1 through the development process are transferred therefrom and superimposed one on another on the intermediate transfer belt 8A. Thus, a multicolor toner image is formed on the intermediate transfer belt 8A.

The four primary transfer bias rollers 9 are pressed against the corresponding photoconductor drums 1 via the intermediate transfer belt 8A, and four contact portions between the primary transfer bias rollers 9 and the corresponding photoconductor drums 1 are hereinafter referred to as primary transfer nips. Each primary transfer bias roller 9 receives a transfer bias, which is opposite in polarity to toner. While rotating in the direction indicated by the arrow illustrated in FIG. 1, the intermediate transfer belt 8A sequentially passes through the primary transfer nips. Then, the single-color toner images are transferred from the photoconductor drums 1 primarily and superimposed one on another on the intermediate transfer belt 8A.

Then, the intermediate transfer belt 8A carrying the multicolor toner image reaches a position facing the secondary transfer roller 19. At that position, the secondary transfer roller 19 presses against a secondary transfer backup roller via the intermediate transfer belt 8A, and the contact portion therebetween is referred to as a secondary transfer nip. The multicolor toner image on the intermediate transfer belt 8A is transferred onto the sheet P (recording medium) transported to the secondary transfer nip. A certain amount of toner tends to remain untransferred on the intermediate transfer belt 8A after the secondary transfer process. The untransferred toner on the intermediate transfer belt 8A is removed by a belt cleaning device, and thus the intermediate transfer belt 8A is initialized. Thus, a sequence of image forming processes performed on the intermediate transfer belt 8A is completed.

The sheet P is transported from the sheet feeding tray 26 provided in a lower portion of the apparatus body 10 to the secondary transfer nip via the sheet feeding roller 27 and the registration roller pair 28. More specifically, the sheet feeding tray 26 contains multiple sheets P piled one on another.

The sheet feeding roller 27 rotates counterclockwise in FIG. 1 to feed the sheet P on the top on the sheet feeding tray 26 toward a nip of the registration roller pair 28. The registration roller pair 28 stops rotating temporarily, stopping the sheet P with a leading edge of the sheet P stuck in the nip. The registration roller pair 28 resumes rotating to transport the sheet P to the secondary transfer nip, timed to coincide with the arrival of the multicolor toner image on the intermediate transfer belt 8A. Thus, the multicolor toner image is recorded on the sheet P.

The sheet P carrying the multicolor toner image is transported to the fixing device 20. In the fixing device 20, a fixing roller and a pressing roller apply heat and pressure to the sheet P to fix the multicolor toner image on the sheet P. Subsequently, the sheet P is discharged by a pair of sheet ejection rollers 29 outside the apparatus body 10 and sequentially stacked, as an output image, in a stack section 30. Thus, a sequence of image forming processes performed in the image forming apparatus 100 is completed.

Next, a configuration and operation of the developing device 5 is described in further detail below with reference to FIG. 2.

FIG. 2 is a schematic cross-sectional view of one of the image forming units 6Y, 6M, 6C, and 6Bk designed as the process cartridge, which is removably installed in image forming sections of respective colors. In FIG. 2, the developing device 5 includes a casing 50 (illustrated in FIG. 3), a developing roller 51 disposed in the casing 50 and facing the photoconductor drum 1, a doctor blade 52 disposed below the developing roller 51, a collecting compartment 58, and a supply compartment 59. The developing roller 51 serves as a developer bearer, and the doctor blade 52 serves as a developer regulator. The collecting compartment 58 and a supply compartment 59 are parts of a developer conveyance passage defined by wall faces inside the casing 50 and arranged in a vertical direction of the casing 50, and first and second conveying screws 53 and 54, serving as developer conveyors, are disposed in the collecting compartment 58 and the supply compartment 59. The developer conveyors are not limited to screws but can be any structure, such as augers and coils, having a capability to transport developer in the axial direction of the developing roller 51. Two-component developer including carrier (carrier particles) and toner (toner particles) is contained in the collecting compartment 58 and the supply compartment 59. The toner used in the present embodiment has shape factors SF-1 and SF-2 both within a range from 100 to 180, for example. The supply compartment 59 is disposed in a lower part of the casing 50 and supplies developer to the developing roller 51.

A toner density sensor 56 is disposed on the casing 50, at a position facing the second conveying screw 54, to detect density of toner or ratio of toner in developer. The first conveying screw 53 faces the developing roller 51 and serves as a collected developer conveyor to mix developer that has left the developing roller 51 with supplied toner. The second conveying screw 54 faces the developing roller 51 from below the developing roller 51 and serves as a supplied developer conveyor to supply developer to the developing roller 51. The first and second conveying screws 53 and 54 are configured to rotate in the opposite direction to transport developer relative to each other, thereby circulating the developer in the direction perpendicular to the surface of the paper on which FIG. 2 is drawn.

Figure 3:
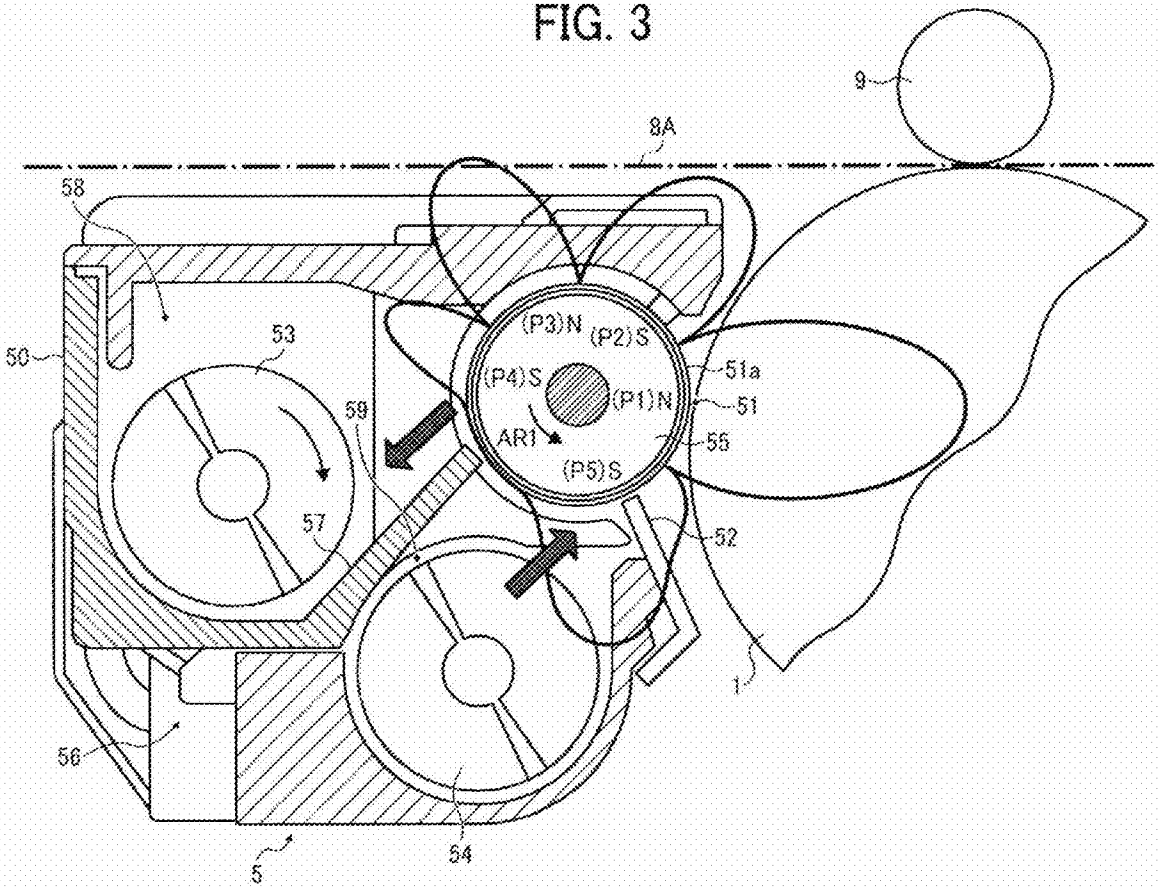
FIG. 3 is a schematic end-on axial view of a developing device according to an embodiment.
Figure 4:
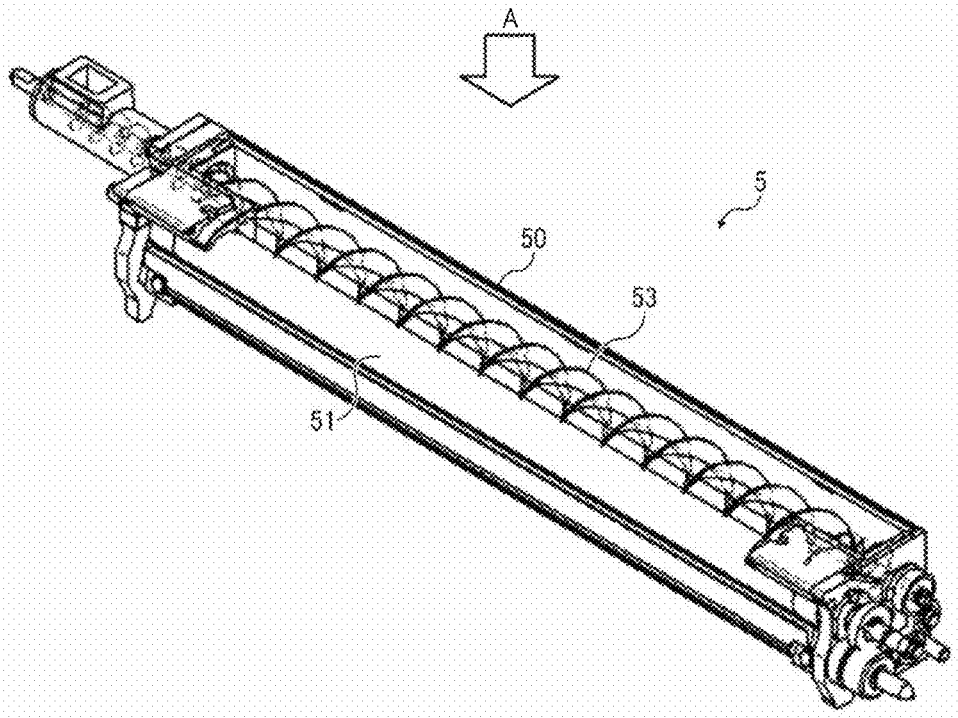
FIG. 4 is a perspective view of a main part of the developing device illustrated in FIG. 3.

FIG. 3 is a schematic cross-sectional view of circulation of developer in the developing device 5, and FIG. 4 is a perspective view of the developing device 5 illustrated in FIG. 3. The developing device 5 illustrated in FIGS. 3 and 4 is similar in configuration to that incorporated in the image forming unit 6 (process cartridge) illustrated in FIG. 2. As illustrated in FIG. 3, the developing roller 51 includes a magnet roller 55 having multiple stationary magnetic poles and a cylindrical developing sleeve 51*a* that rotates around the magnet roller 55. The magnet roller 55 of the developing roller 51 includes, for example, five magnetic poles P1 through P5. As the developing sleeve 51*a* rotates around the magnet roller 55 having the five magnetic poles, developer moves, carried on the developing sleeve 51*a*, in the circumferential direction (in the direction of arc) of the developing roller 51. It is to be noted that curved lines radiating from the magnet roller 55 represents ranges of magnetic fields (magnetic force) of the magnetic poles P1 through P5. The pole P1 is a main pole to cause developer to stand on end into a magnetic brush in the developing range, the pole P2 is a conveyance pole, the pole P3 is a pre-release pole, the pole P4 is a developer release pole, and the pole P5 is a developer scooping pole.

It is to be noted that, although the magnet roller 55 illustrated in FIG. 3 has the five magnetic poles P1 through P5, the number of the magnetic poles is not limited thereto and is, for example, four or six in other embodiments. Alternatively, instead of a magnet roller, multiple stationary magnets are used in another embodiment. The arrangement of polarity, north (N) or south (S), of the magnetic poles P1 through P5 illustrated in FIG. 3 is an example, and the north poles and the south poles can be reversed.

Next, a configuration for unidirectional circulation in the developing device according to the present embodiment is described below.

The developing device 5 illustrated in FIG. 3 includes the developing roller 51, the doctor blade 52, the collecting compartment 58 serving as a developer conveyance compartment, the first conveying screw 53 disposed in the first conveying screw 53, the supply compartment 59 serving as another developer conveyance compartment, the second conveying screw 54 disposed in the supply compartment 59, and a partition 57 to partition, at least partly, the collecting compartment 58 and the supply compartment 59 from each other. In the collecting compartment 58 and the supply compartment 59, for example, 300 grams of developer including toner (of about 5.2 μm in particle diameter), a main ingredient of which is polyester resin, and magnetic carrier (of about 35 μm in particle diameter) is contained. In the developer, the toner and the magnetic carrier are mixed uniformly, and the percentage of toner in the developer is about 7% by weight, for example. The first conveying screw 53 and the second conveying screw 54 disposed side by side are rotated at a speed of, for example, about 600, thereby stirring and transporting the supplied toner simultaneously. Thus, the toner and carrier can are mixed uniformly and charged electrically.

While being transported in the longitudinal direction (i.e., the axial direction) by the second conveying screw 54 adjacent to and parallel to the developing sleeve 51*a*, developer in which toner and carrier are mixed uniformly is attracted by the magnetic force exerted by the poles P4 and P5 of the magnet roller 55 inside the developing sleeve 51*a* onto an outer circumferential face of the developing sleeve 51*a*. As the developing sleeve 51*a* rotates in the direction indicated by arrow AR1 in FIG. 3, developer is transported to the developing range formed by the photoconductor drum 1 and the developing sleeve 51*a*. By an electrical field generated by a high-pressure power source, the latent image on the photoconductor drum 1 is developed with the toner.

As the developing sleeve 51*a* rotates, the developer that has passed through the developing range is collected by the first conveying screw 53 via the partition 57 in the casing 50.

Figure 5A:
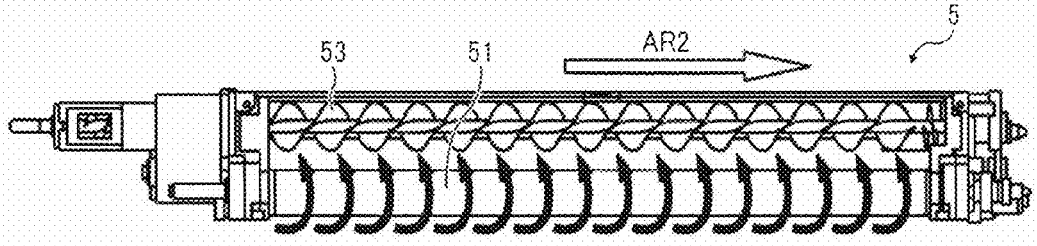
FIGS. 5A, 5B, and 5C are views of the developing device illustrated in FIG. 4, for understanding of circulation of developer.
Figure 5B:
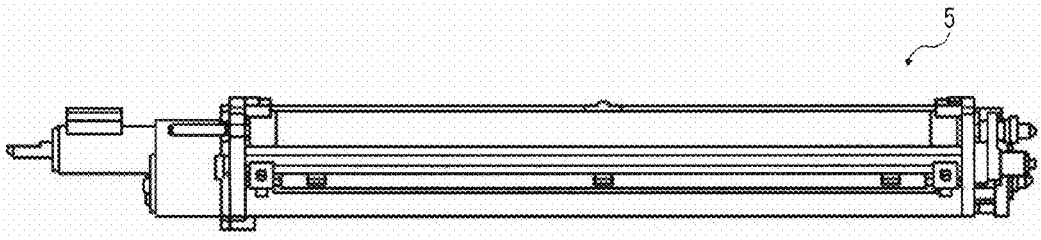
Figure 5C:
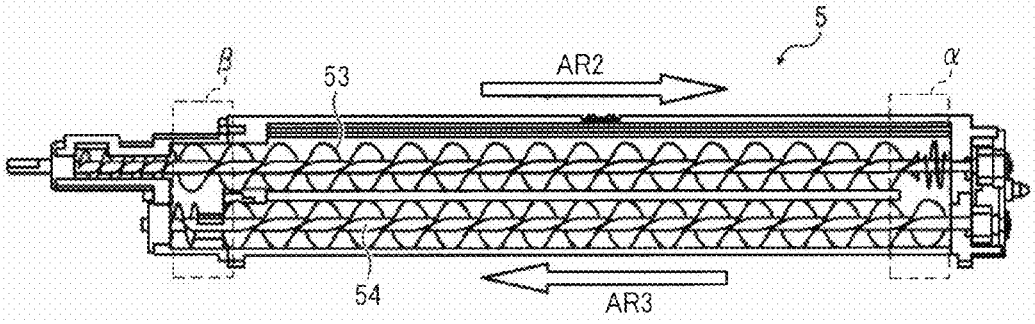

FIGS. 5A, 5B, and 5C are views of the developing device 5 as viewed in the direction indicated by arrow A in FIG. 4, and the casing 50 is omitted in FIGS. 5A, 5B, and 5C for ease of understanding. Arrows AR2 and AR3 represent the developer conveyance directions. FIG. 5A illustrates the movement of developer including developer collected from the developing sleeve 51*a*, transported by the first conveying screw 53 in the collecting compartment 58. FIG. 5B is a front view of the developing device 5 illustrated in FIG. 5A.

FIG. 5C illustrates directions in which developer is transported (i.e., developer conveyance direction) by the conveying screws 53 and 54 in the collecting compartment 58 and the supply compartment 59. In FIGS. 5A through 5C, the collecting compartment 58 and the supply compartment 59 vertically communicate with each other in end areas a and 0, which are at axial ends of the conveying screws 53 and 54. Developer is transported downward in the end area α and transported upward in the end area β. A paddle or a reversed spiral blade is provided to each end portion of the conveying screws 53 and 54 positioned in the end areas a and (3 to transport developer in a direction perpendicular to the developer conveyance direction indicated by arrow AR2 or AR3. In other words, the developing device 5 includes communicating portions at both longitudinal ends of the two compartments to circulate developer inside the developing device 5.

Figure 6:
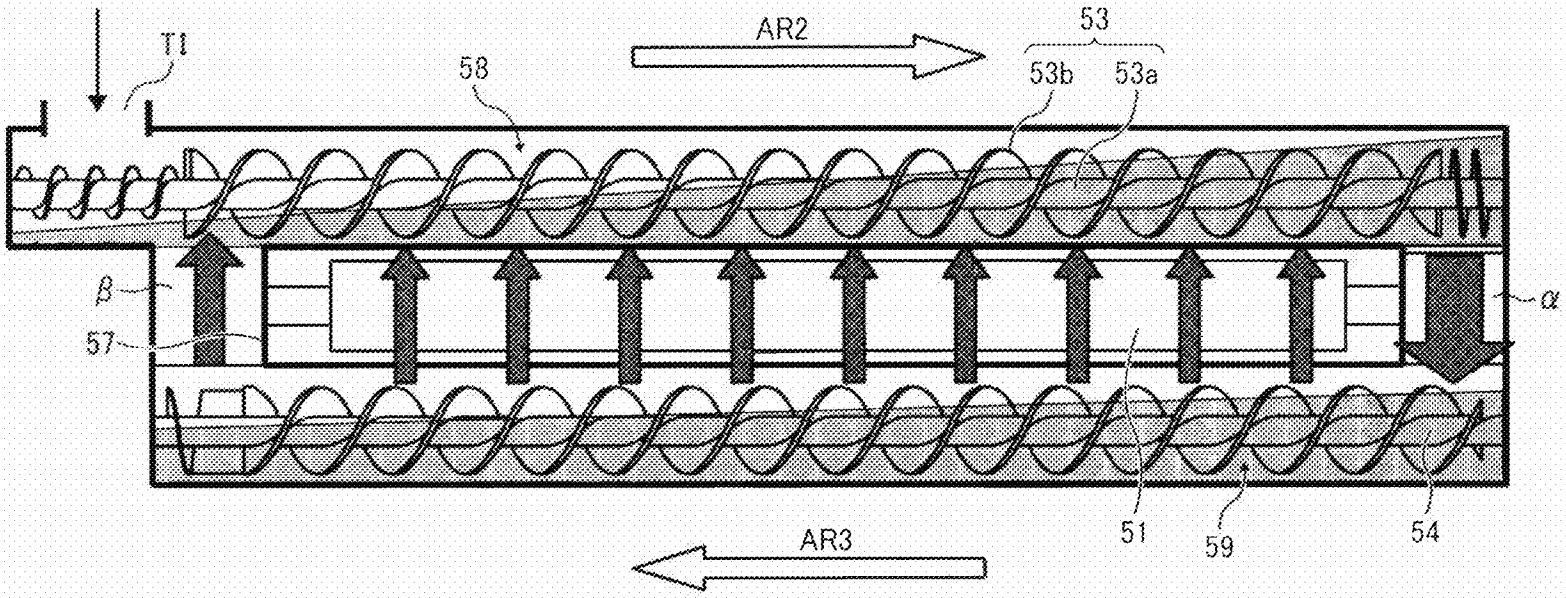
FIG. 6 is a view of a collecting compartment and a supply compartment in the developing device illustrated in FIG. 4, between which developer is circulated.

FIG. 6 is a schematic diagram illustrating movement of developer in the longitudinal direction inside the developing device 5 illustrated in FIGS. 3 and 4.

Figure 7A:
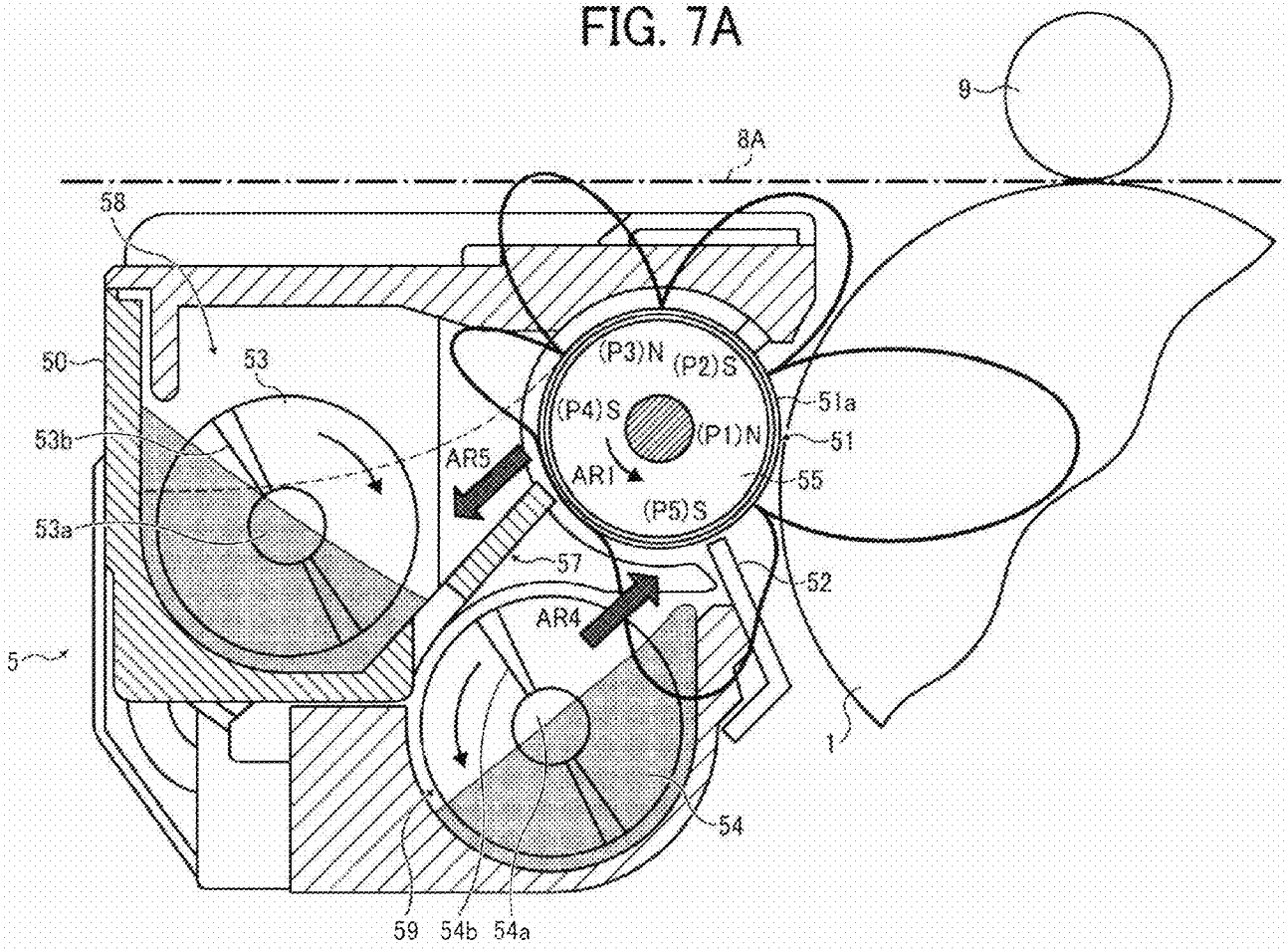
FIG. 7A is a schematic view of a developing device according to a first embodiment.

In the supply compartment 59, the second conveying screw 54 transports developer in the direction indicated by arrow AR3 illustrated in FIG. 6, and a part of developer transported by the second conveying screw 54 is scooped onto the developing sleeve 51*a* by the magnetic force of the developing roller 51 as indicated by arrow AR4 in FIG. 7A.

The developer that has passed through the developing range is separated from the developing sleeve 51*a* by the partition 57 and collected in the first conveying screw 53 in which the first conveying screw 53 is disposed as indicated by arrow AR5 in FIG. 7A. The partition 57 is partly absent outside the developing range of the developing roller 51 so that the collecting compartment 58 and the supply compartment 59 communicate with each other. The developer transported by the second conveying screw 54 but is not used in image development is transported from the end area β on the downstream side in the developer conveyance direction by the second conveying screw 54, indicated by arrow AR3, to the collecting compartment 58, where the first conveying screw 53 is positioned.

As illustrated in FIGS. 4 and 6, a toner inlet TI is disposed in the collecting compartment 58, where the first conveying screw 53 is disposed. The toner inlet TI is positioned outside a range of a spiral blade 53*b* provided to a shaft 53*a* of the first conveying screw 53. Toner is supplied from the toner inlet TI and mixed with the developer transported from the second conveying screw 54, and the mixture is transported while being stirred. The developer transported by the first conveying screw 53 includes the developer collected from the developing roller 51 downstream from the developing range. In the end area α on the downstream side in the developer conveyance direction by the first conveying screw 53, developer is received from the first conveying screw 53 into the supply compartment 59, where the second conveying screw 54 is disposed.

As described above, in the developing device 5 illustrated in FIGS. 3 through 6, developer is transported unidirectionally by the first and second conveying screws 53 and 54. While being transported unidirectionally, the developer is supplied to the developing roller 51, collected from the developing roller 51, and mixed with supplied toner.

Next, distinctive features of the developing device according to embodiments of the present invention are described below.

First Embodiment

FIG. 7A illustrates the unidirectional-circulation developing device 5.

The first and second conveying screws 53 and 54 are the developer conveyors disposed in the developing device 5, and repellency or resistance to adhesion of developer is given to faces of the first and second conveying screws 53 and 54 that contact the developer contained in the casing 50. The shaft 53*a* and the spiral blade 53*b* of the first conveying screw 53 contact developer. Similarly, a shaft 54*a* and a face a spiral blade 54*b* of the second conveying screw 54 contact developer. It is to be noted that the first and second conveying screws 53 and 54 may be simply referred to as "conveying screws 53 and 54" below.

Figure 7B:
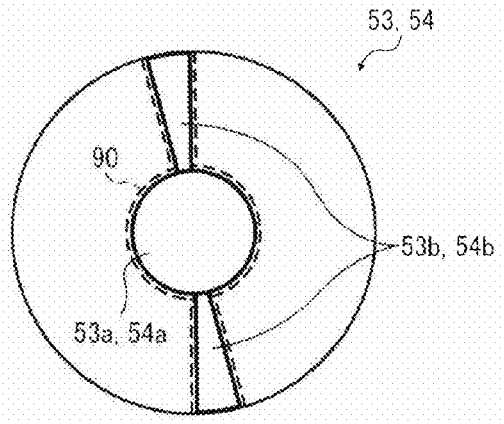
FIG. 7B is an enlarged cross-sectional view of a developer conveyor according to the first embodiment.

Specifically, in the first embodiment, the conveying screws 53 and 54 are made repellent to developer as follows. Longitudinal ends of each of the conveying screws 53 and 54 are masked. Then, a substance that is repellent or resistive to adhesion of developer (hereinafter "developer-repellent substance") is sprayed to the remaining portions (exposed faces) of the conveying screws 53 and 54. Thus, coated faces (hereinafter "repellent faces 90"), indicated by broken lines in FIG. 7B, are formed.

The repellency to developer of the first and second conveying screws 53 and 54 was evaluated by forming images of a relatively low image area, in which the amount of toner replaced in the developing device 5 is smaller. In the evaluation, developer did not adhere to the conveying screws 53 and 54 even when the flowability of developer was degraded over time. The occurrence of image failure caused by insufficient dispersion of supplied toner was not recognized. Additionally, the amount of developer discharged by automatic developer replacement was improved to the level equivalent to fresh developer (initial developer). Therefore, work of users or operators for replacing developer is simplified. Repellency to developer is described in further detail later.

Variations of the first embodiment are described below.

(Variation 1)

Figure 8A:
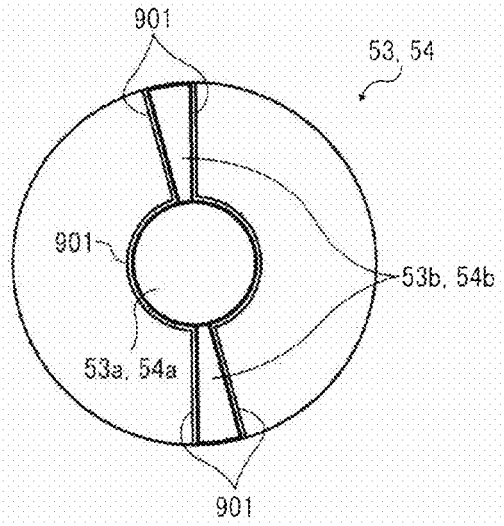
FIG. 8A is an enlarged cross-sectional view of a developing conveyor according to a first variation.

In a first variation illustrated in FIG. 8A, a repellent sheet 901 is bonded to the portions of the shafts 53*a* and 54*a* and the spiral blades 53*b* and 54*b* of the conveying screws 53 and 54, instead of spraying the developer-repellent substance as illustrated in FIGS. 7A and 7B. That is, the repellent sheet 901 serves as the developer-repellent faces in the first variation. The repellent sheet 901 according to the first variation is about 100 μm in thickness and includes an adhesive back face. The repellent sheet 901 is cut to fit the shafts 53*a* and 54*a* and the spiral blades 53*b* and 54*b*, or the shapes of the spiral blades 53*b* and 54*b*, and bonded to the conveying screws 53 and 54.

The repellency to developer of the first and second conveying screws 53 and 54 according to the first variation was evaluated similarly, by forming images of a relatively low image area, in which the amount of toner replaced in the developing device 5 is smaller. In the evaluation, developer did not adhere to the conveying screws 53 and 54 even when the flowability of developer was degraded over time. The occurrence of image failure caused by insufficient dispersion of supplied toner was not recognized. Additionally, the amount of developer discharged by automatic developer replacement was improved to the level equivalent to initial developer. Therefore, work of users or operators for replacing developer is simplified.

(Variation 2)

Figure 8B:
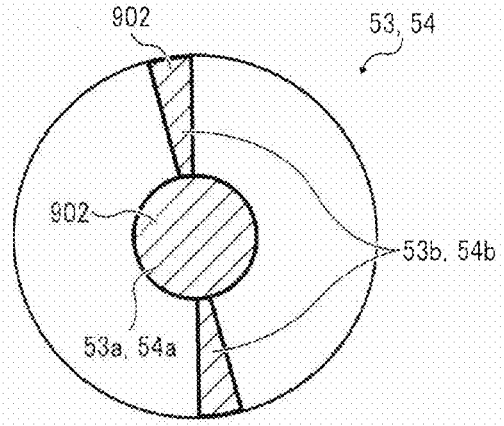
FIG. 8B is an enlarged cross-sectional view of a developer conveyor according to a second variation.

In a second variation illustrated in FIG. 8B, the faces of the conveying screws 53 and 54 themselves are made repellent to developer, differently from the first variation in which developer-repellent faces are made of the repellent sheet 901 bonded to the conveying screws 53 and 54. Specifically, the conveying screws 53 and 54 are made of or include a material repellent to developer. Alternatively, the conveying screws 53 and 54 include repellent faces 902 having a nano size surface roughness pattern defined by minute (nano-size) projections and recesses to repel developer. In this case, repellency is given to the conveying screws 53 and 54 in an easier manner than attaching the repellent sheet 901 to the conveying screws 53 and 54, which include curved faces. It is to be noted that methods of forming the developer-repellent faces are not limited to the examples described above.

(Variation 3)

Figure 9:
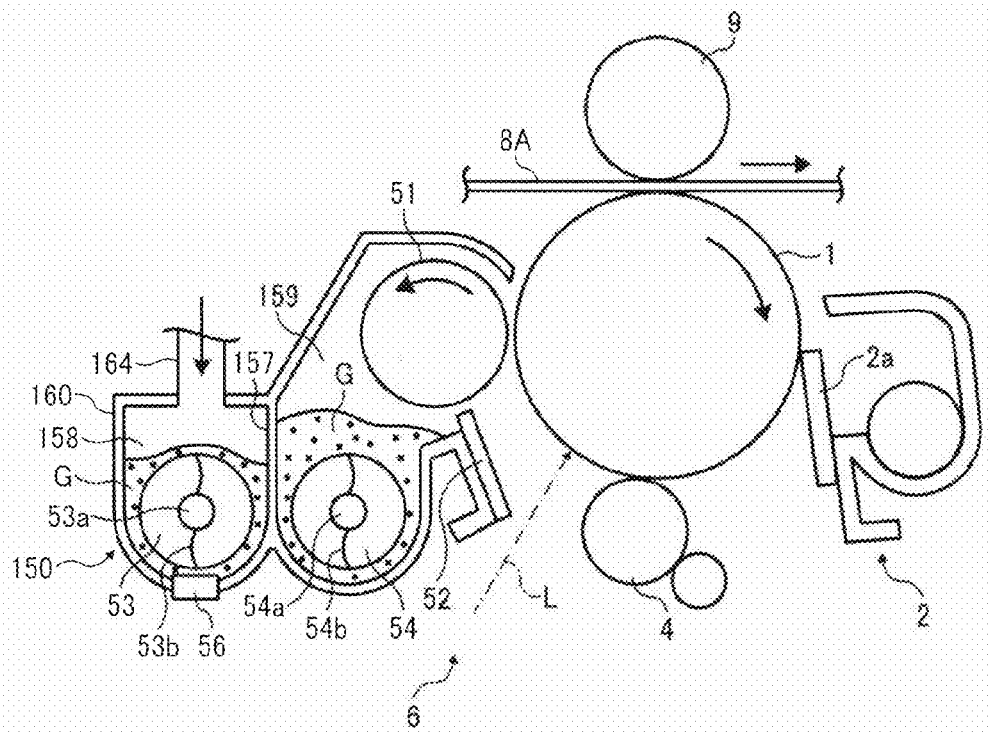
FIG. 9 is a schematic view of a developing device according to a third variation.

A third variation relate to a biaxial-circulation developing device including a conveying screw provided with repellency to developer. Referring to FIG. 9, a developing device 150 employing biaxial circulation is described below.

The developing device 150 illustrated in FIG. 9 is a part of the image forming unit 6 configured as the process cartridge attachable to and removable from the apparatus body 10. The developing device 150 includes the developing roller 51, the doctor blade 52, a collecting compartment 158 serving as a developer conveyance compartment, the first conveying screw 53 disposed in the first conveying screw 53, a supply compartment 159 serving as another developer conveyance compartment, the second conveying screw 54 disposed in the supply compartment 159, and a partition 157 to partition, at least partly, the collecting compartment 158 and the supply compartment 159 from each other. In the collecting compartment 158 and the supply compartment 159 inside a casing 160 of the developing device 150, for example, 300 grams of developer G including toner (of about 5.2 μm in particle diameter), a main ingredient of which is polyester resin, and magnetic carrier (of about 35 μm in particle diameter) is contained. In the developer, the toner and the magnetic carrier are mixed uniformly, and the percentage of toner in the developer is about 7% by weight, for example. The first conveying screw 53 and the second conveying screw 54 disposed side by side are rotated at a speed of, for example, about 600, thereby stirring and transporting the supplied toner simultaneously. Thus, the toner and carrier can are mixed uniformly and charged electrically.

The second conveying screw 54 is disposed adjacent to and parallel to the developing sleeve 51*a*. While being transported by the second conveying screw 54 in the longitudinal direction thereof (i.e., the axial direction), developer G in which toner and carrier are mixed uniformly, is attracted by the magnetic force of the magnet roller 55 inside the developing sleeve 51*a* onto the outer circumferential face of the developing sleeve 51*a*. As the developing sleeve 51*a* rotates in the direction indicated by an arrow in the drawing, the developer G is transported to the developing range between the photoconductor drum 1 and the developing sleeve 51*a*, where the latent image on the photoconductor drum 1 is developed with the toner by an electrical field generated by a high-pressure power source. As the developing sleeve 51*a* rotates, the developer G that has passed through the developing range is collected by the first conveying screw 53 via the partition 157 in the casing 160. Additionally, to the collecting compartment 158, toner is supplied through a supply passage 164 by a toner supply device.

In the biaxial-circulation developing device 150, similarly, when developer solidifies and firmly adheres to the conveying screws 53 and 54 over time, inconveniences are caused. For example, supplied toner is not properly dispersed. If the firmly adhering developer falls and gets stuck in the gap between the developing roller 51 and the doctor blade 52 (i.e., a doctor gap), white streaks (voids) appear on images. If the developer in aggregated form passes through the doctor gap, it appears as a spot in images. Accordingly, in the present embodiment and the variations, firm adhesion of developer is inhibited.

Therefore, the developing device 150 according to the third variation includes the conveying screws 53 and 54 according to any one of the first embodiment illustrated in FIG. 7B, the first variation illustrated in FIG. 8A, or the second variation illustrated in FIG. 8B. That is, the conveying screws 53 and 54 according to the third variation contact developer G contained in the casing 160, and the repellent faces 90 repellent to developer illustrated in FIG. 7B, 8A, or 8B are provided to the shafts 53*a* and 54*a* and the spiral blades 53*b* and 54*b* of the conveying screws 53 and 54.

The repellency to developer of the first and second conveying screws 53 and 54 was evaluated by forming images of a relatively low image area, in which the amount of toner replaced is smaller. In the evaluation, adhesion of developer did not occur even when the flowability of developer was degraded over time.

(Variation 4)

In a fourth variation described below with reference to FIGS. 10A, 10B, and 11, the faces repellent to developer are adopted in a developing device including three developer conveyors to transport developer in the developing device.

Figure 10A:
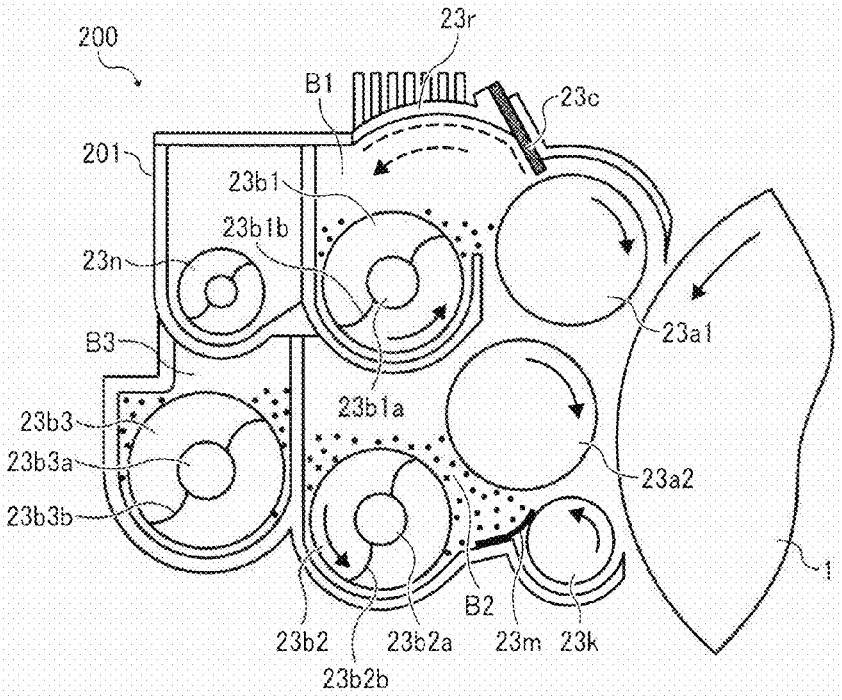
FIG. 10A is a schematic view of a developing device according to a fourth variation.
Figure 10B:
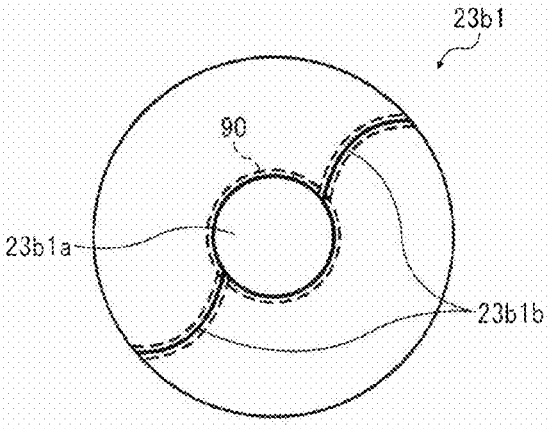
FIG. 10B is an enlarged cross-sectional view of a developer conveyor according to the fourth embodiment.
Figure 11:
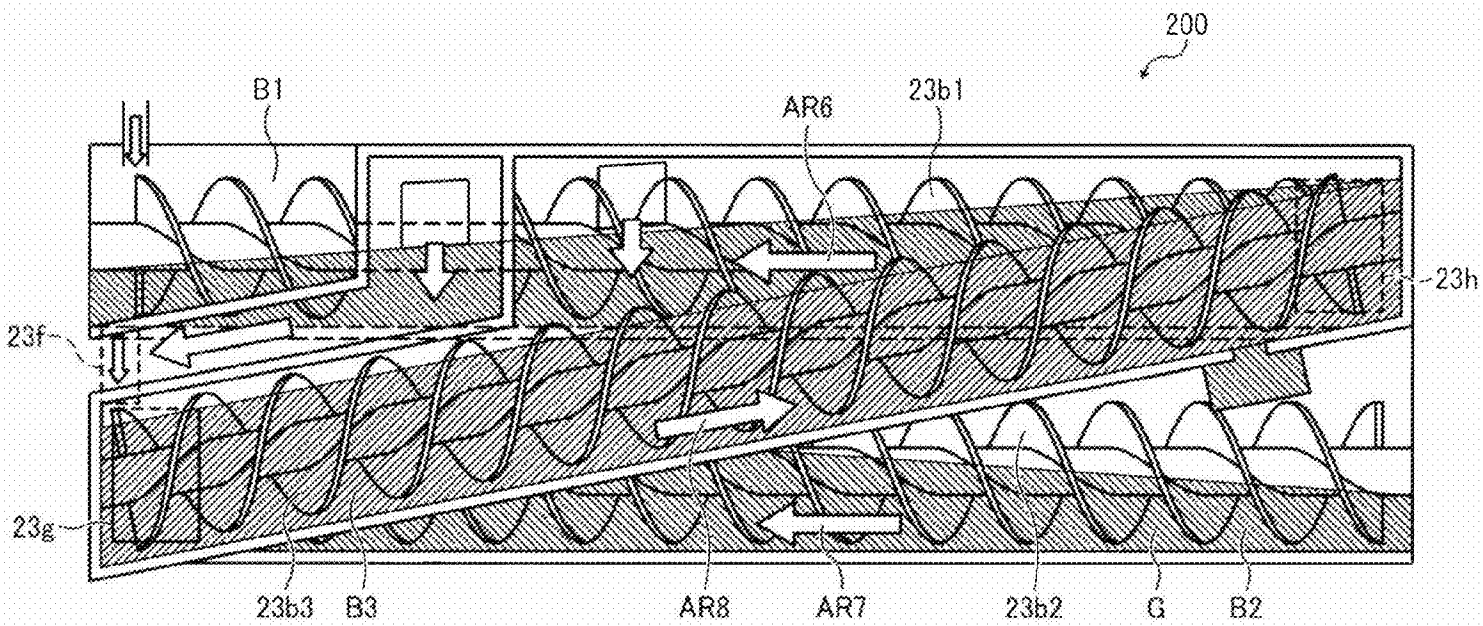
FIG. 11 is a schematic view illustrating circulation of developer in the developing device according to the fourth variation.

A developing device 200 illustrated in FIGS. 10A and 11 is a part of the image forming unit 6 configured as the process cartridge attachable to and removable from the apparatus body 10. Needless to say, the developing device 200 may be removably mountable to the apparatus body 10 independently, not as a part of the process cartridge.

A configuration and operation of the developing device 200 are described.

With reference to FIG. 10A, the developing device 200 includes two developer bearers, namely, first and second developing rollers 23*a*1 and 23*a*2; three developer conveyors, namely, conveying screws 23*b*1, 23*b*2, and 23*b*3 (augers); a doctor blade 23*c* serving as a developer regulator; a carrier collecting roller 23*k*; a scraper 23*m*; a discharge screw 23*n*; an upper case 23*r* serving as a casing member; and the like. A casing 201 and an interior of the developing device 200 together define three conveyance compartments B1, B2, and B3 (i.e., a supply compartment, a collection compartment, and a stirring compartment or conveyance compartment). Referring to FIG. 11, developer G including toner (i.e., toner particles) and carrier (i.e., carrier particles) is contained in the developing device 200.

Each of the first and second developing rollers 23*a*1 and 23*a*2 includes a cylindrical sleeve made of a nonmagnetic material such as aluminum, brass, stainless steel, or conductive resin and is rotated clockwise in FIG. 10A by a driving unit. Magnets secured inside the sleeves of the first and second developing rollers 23*a*1 and 23*a*2 generate magnetic fields to cause developer to stand on end on the circumferential surfaces of the sleeves. Along magnetic force lines arising from the magnets in a normal direction, the carrier in developer stands on end, in a chain shape. Toner adheres to the carrier standing on end in the chain shape, thus forming a magnetic brush. As the sleeve rotates, the magnetic brush is transported in the direction of rotation of the sleeve (clockwise in the drawing).

Specifically, multiple magnetic poles are generated around each of the first and second developing rollers 23*a*1 and 23*a*2 by the magnet disposed inside the sleeve. The magnetic poles around the first developing roller 23*a*1 include a developer scooping pole to scoop up developer from the conveyance compartment B1, a regulation pole facing the doctor blade 23*c*, a main pole disposed in a range facing the photoconductor drum 1, and a conveyance pole to transport developer to a position facing the second developing roller 23*a*2.

The magnetic poles around the second developing roller 23*a*2 include a developer receiving pole to receive developer from the first developing roller 23*a*1, a main pole disposed in the range facing the photoconductor drum 1, a pole facing the carrier collecting roller 23*k*, and a developer release pole to release developer toward the conveyance compartment B2.

The doctor blade 23*c* serving as a developer regulator is disposed upstream from the developing range to adjust the amount of developer carried on the first developing roller 23*a*1. In the present variation, the doctor blade 23*c* is a planar member having a thickness of about 2 mm, made of or including nonmagnetic metal such as SUS (Steel Use Stainless) 316 or XM7 according to Japan Industrial Standard (JIS). It is to be noted that a thin plate of about 0.3 mm made of magnetic metal such as SUS430 or the like may be provided to a position facing the doctor blade 23*c*.

Each of the conveying screws 23*b*1, 23*b*2, and 23*b*3 includes a spiral blade provided to a shaft and stirs developer contained in the developing device 200 while circulating developer in the longitudinal direction or the axial direction (hereinafter "developer conveyance direction"), perpendicular to the surface of the paper on which FIG. 10A is drawn. The conveying screw 23*b* 1 is disposed in the conveyance compartment B1 to face the developing roller 23*a*1. The conveying screw 23*b*1 transports developer G to horizontally (to the left in FIG. 11, indicated by arrow AR6) and supplies the developer G to the developing roller 23*a*1. In other words, the conveying screw 23*b*1 faces the developing roller 23*a*1 and supplies developer to the developing roller 23*a*1 while transporting developer G in the longitudinal direction (the axial direction of the developing roller 23*a*1).

The conveying screw 23*b*2 is disposed in the conveyance compartment B2. The conveying screw 23*b*2 is disposed below the conveying screw 23*b*1 and faces the developing roller 23*a*2. The conveying screw 23*b*2 horizontally (to the left in FIG. 11, indicated by arrow AR7) transports developer G that has left the developing roller 23*a*2 (developer that is forced to leave the developing roller 23*a*2 by the developer release pole). In other words, the conveying screw 23*b*2 is disposed below the conveyance compartment B1 and facing the developing roller 23*a*2, and transports, in the longitudinal direction, the developer G that has left the developing roller 23*a*2. The conveying screws 23*b*1 and 23*b*2 are disposed so that their axes of rotation are substantially horizontal similarly to the developing rollers 23*a*1 and 23*a*2 and the photoconductor drum 1. In the description below, the term "upstream side" and "downstream side" of each of the conveyance compartments B1, B2, and B3 are based on the direction in which developer is transported in that compartment.

The conveying screw 23*b*3 is disposed in the conveyance compartment B3. The conveying screw 23*b*3 is oblique to the horizontal direction to linearly connect the downstream side of the conveyance compartment B2, where the conveying screw 23*b*2 is disposed, and the upstream side of the conveyance compartment B1, where the conveying screw 23*b*1 is disposed (see FIG. 11). The conveying screw 23*b*3 forwards developer G transported from the conveying screw 23*b*2 to the upstream side of the conveyance compartment B1, where the conveying screw 23*b*1 is disposed, and transports (to the upper right in FIG. 11, indicated by arrow AR8) developer G circulated from the downstream side of the conveyance compartment B1, where the conveying screw 23*b*1 is disposed, via a downward passage 23*f* to the upstream side of the conveyance compartment B1. In other words, the conveying screw 23*b*3 forwards developer G transported through the conveyance compartment B2 to the upstream side of the conveyance compartment B1 and transports developer G from the downstream side of the conveyance compartment B1 to the upstream side of the conveyance compartment B1.

That is, the conveyance compartment B1 serves as a developer supply compartment, the conveyance compartment B2 serves as a developer collecting compartment, and the conveyance compartment B3 serves as a developer conveyance compartment.

Specifically, inner walls of the developing device 200 separate, from each other, the conveyance compartment B1, in which the conveying screw 23*b*1 transports developer, the conveyance compartment B2, in which the conveying screw 23*b*2 transports developer, and the conveyance compartment B3, in which the conveying screw 23*b*3 transports developer. Referring to FIG. 11, the downstream side of the conveyance compartment B2 communicates with the upstream side of the conveyance compartment B3 via a first communicating portion 23*g*. The downstream side of the conveyance compartment B3 communicates with the upstream side of the conveyance compartment B1 via a second communicating portion 23*h*. The downstream side of the conveyance compartment B1 communicates with the upstream side of the conveyance compartment B3 via a downward passage 23*f*.

Thus, the conveying screws 23*b*1 through 23*b*3, disposed in the conveyance compartments B1 through B3, circulate developer G in the longitudinal direction through a developer conveyance passage defined by wall faces inside the casing 201 of the developing device 200. When the developing device 200 is activated, the developer G contained therein flows in the state indicated by the hatching in FIG. 11.

Referring to FIG. 11, in the conveyance compartment B1, the level of developer G is lower on the downstream side than the upstream side because a part of the developer G is supplied to the developing roller 23*a*1 while being transported. The developer G that is not supplied to the developing roller 23*a*1 moves through the downward passage 23*f* to the upstream side of the conveyance compartment B3.

In the developing device 200 according to the fourth variation, the conveying screws 23*b*1 through 23*b*3 disposed in the conveyance compartments B1 through B3 contact developer G in the casing 201. Accordingly, faces of the conveying screws 23*b*1 through 23*b*3 are made repellent to developer. Specifically, the repellent faces 90 similar to the configuration illustrated in FIG. 7B, 8A, or 8B, are provided to shafts 23*b*1*a*, 23*b*2*a*, and 23*b*3*a* of the conveying screws 23*b*1, 23*b*2, and 23*b*3 and spiral blades 23*b*1*b*, 23*b*2*b*, and 23*b*3*b* winding around the shafts 23*b*1*a*, 23*b*2*a*, and 23*b*3*a*. It is to be noted that, although FIG. 10B illustrates the conveying screw 23*b*1 as a representative of the conveying screws 23*b*1, 23*b*2, and 23*b*3, and the conveying screws 23*b*2 and 23*b*3 includes repellent faces 90 similarly.

The developer repellency of the conveying screws 23*b*1 through 23*b*3 was evaluated by forming an image having a relatively small image area. When the image area is small, the amount of toner replaced is small. In the evaluation, adhesion of developer did not occur even when the flowability of developer was degraded over time. The occurrence of image failure caused by insufficient dispersion of supplied toner was not recognized. Additionally, the amount of developer discharged by automatic developer replacement was improved to the level equivalent to initial developer. Therefore, work of users or operators for replacing developer is simplified.

In the above-described first embodiment and the variations thereof, developer repellency is given to the faces of the conveying screws serving as the developer conveyors disposed in the developing devices 5, 150, and 200 (hereinafter represented by "developing device 5"), or the portions of the conveying screws to contact developer are made of a material repellent to developer. Alternatively, the portions of the conveying screws are shaped to have a nano-size surface roughness pattern to repel developer.

In a fifth variations and subsequent variations described below, repellency to developer is given to a face of the casing that contacts developer contained in the developing device 5, instead of the developer conveyors. It is to be noted that developing devices according to the fifth and subsequent variations can be similar in mechanical structure to those according to the first embodiment and the first through fourth variations, and the structure of the developing device 5 according to the first embodiment is used in the description below.

(Variation 5)

The fifth embodiment is described using the unidirectional-circulation developing device 5 illustrated in FIG. 7A.

Figure 12:
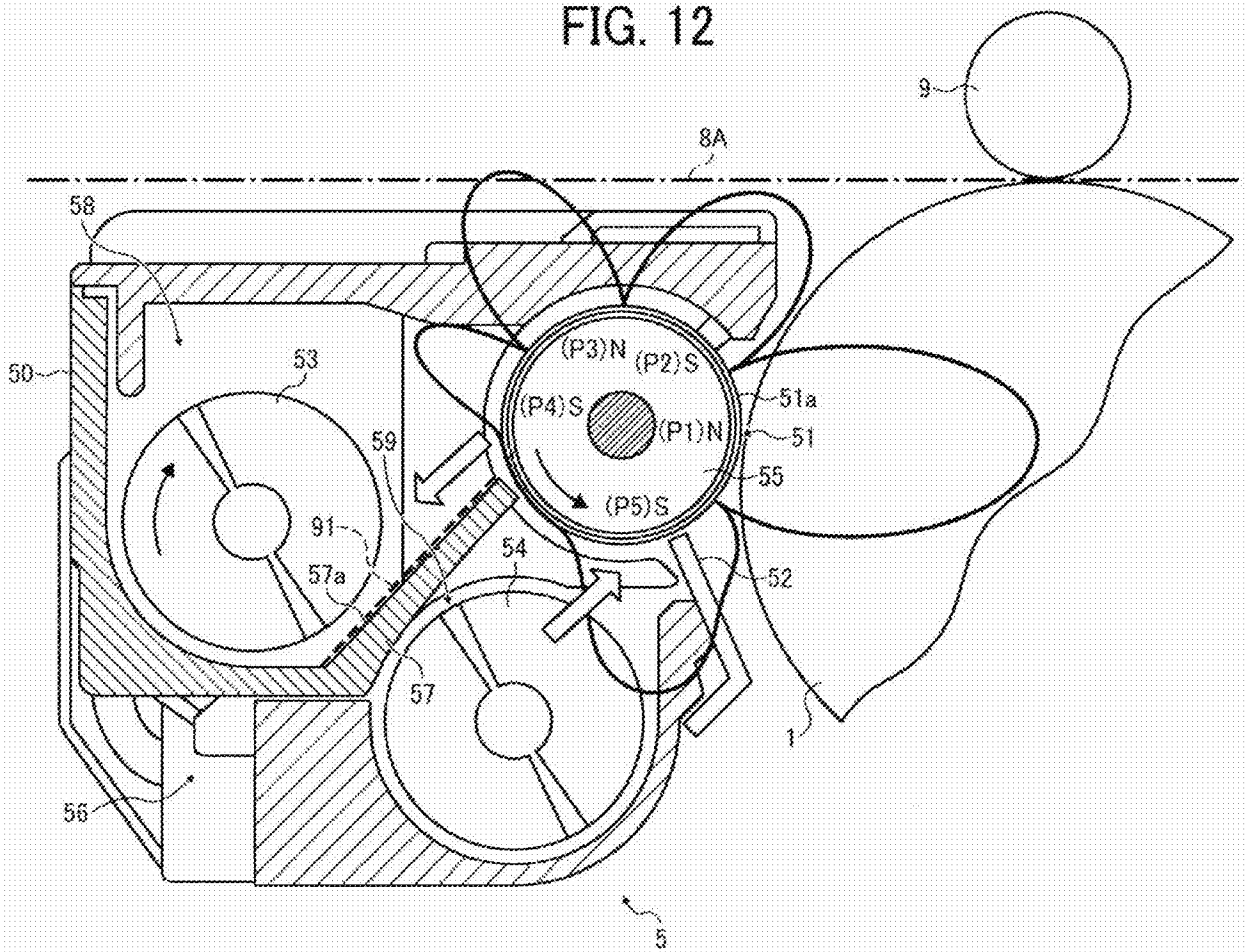
FIG. 12 is a schematic view of a developing device according to a fifth variation, including a guide face to guide collected developer.

FIG. 12 illustrates flow of the developer in the developing device 5.

After used in image development, developer leaves the developing roller 51 and moves to the first conveying screw 53 (i.e., the collected developer conveyor), being guided by a guide face 57*a* (i.e., a collected developer guide). The guide face 57*a* is a face of the partition 57 (i.e., a collection-side face) facing the conveying screw 53. The guide face 57*a* extends, at least, over the length of the developing roller 51 in the longitudinal direction thereof. The developing device 5 is designed to cause developer flow down under the gravity from the developing roller 51 to the first conveying screw 53. Accordingly, in the case of developer having degraded flowability due to degradation with time or environmental changes, it is possible that developer does not move under the gravity but remains on the guide face 57*a*.

In the fifth variation, in the casing 50 of the developing device 5, repellency to develop is given to a face that contacts developer and disposed on the route of developer, in particular, at a position where developer tends to remain. Specifically, the guide face 57*a* (to guide collected developer) of the partition 57 includes a repellent sheet 91 repellent to developer, serving as the repellent face.

With this configuration, even when the developer having degraded flowability moves at the interface with the guide face 57*a*, developer is inhibited from being retained there. Therefore, unevenness in image density caused by insufficient collection of developer is prevented or reduced. Additionally, this configuration inhibits firm adhesion of developer to the guide face 57*a* and image failure such as white streaks and spots caused by the firm adhesion.

The inventors has recognized that, in the developing device 5 according to the fifth variation, most of retention of developer or adhesion of developer in the casing 50 occurs on the guide face 57*a* in the collecting compartment 58. Then, the inventors has confirmed that forming the repellent face on the guide face 57*a* (to guide collected developer) is effective in alleviating image failure such as white streaks and spots. Making only the guide face 57*a* repellent to developer is advantageous since the image failure is reduced at a lower cost compared with giving developer repellency to the entire collecting compartment 58.

(Variation 6)

Figure 13:
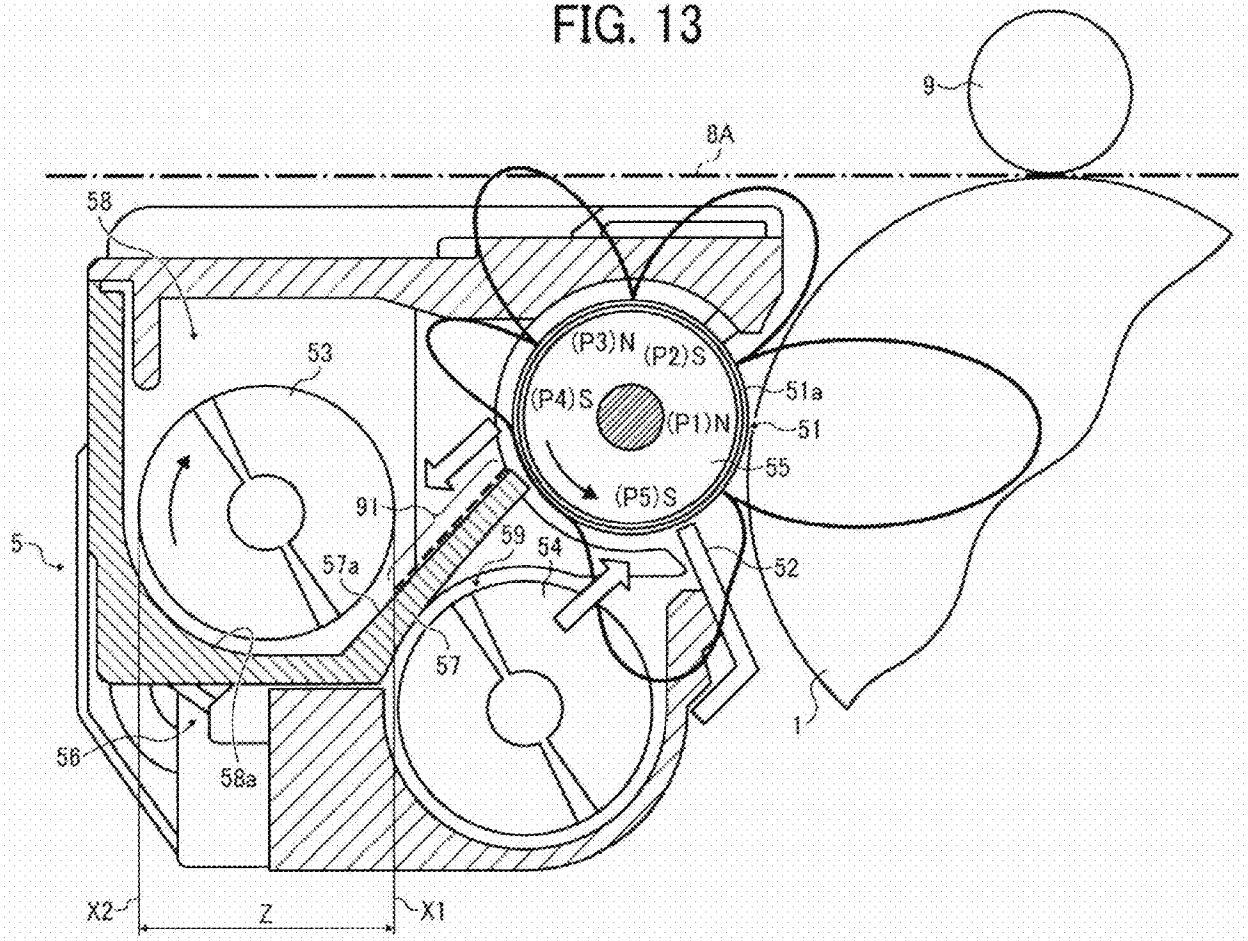
FIG. 13 is a schematic view of a developing device according to a sixth variation, including a guide face to guide collected developer.

In a variation 6 illustrated in FIG. 13, the guide face 57*a*, which is inclined down from the developing roller 51 toward the collecting compartment 58, extends to a position under the first conveying screw 53. Developer repellency is not given to a range Z defined by two tangent lines X1 and X2 tangential to an outline (in the direction of arc) of the first conveying screw 53 and extending vertically down from the points of contact with the outline of the first conveying screw 53. In other words, in the collecting compartment 58, an inner face 58*a* (arc portion) positioned in the range Z and a lower part of the inclined guide face 57*a* positioned in the range Z does not include the repellent face. That is, in the collecting compartment 58, the repellent face 91 (represented by broken line on the guide face 57*a* in FIG. 13) extends in a part of the inclined guide face 57*a* outside the range Z below the first conveying screw 53. The first conveying screw 53 exerts conveyance force in the range Z. Accordingly, it is possible that the repellent face is abraded or scraped off by a strong pressure if the developer conveyance speed is fast or the distance between the first conveying screw 53 and the guide face 57*a* is short. Then, effect to inhibit adhesion of developer is lost. Moreover, the developer-repellent material scraped off from the repellent sheet 91 may change the property of developer or appears in output images, degrading image quality. Therefore, the repellent sheet 91 is not provided in the range Z.

Conversely, in the developing device 5 under such conditions, developer is not retained in the range Z since developer actively moves in the range Z. Accordingly, the occurrence of image failure as well as retention and adhesion of developer to the guide face 57*a* are inhibited by excluding, from the area made repellent to developer, the range Z defined by the two tangent lines X1 and X2, which extend vertically and tangential to the outline of the first conveying screw 53.

In the variations 5 and 6, to make the guide face 57*a* repellent to developer, for example, the repellent sheet 91 is attached to the guide face 57*a* or liquid repellent to developer is sprayed to the guide face 57*a*.

The method of making the guide face 57*a* repellent to developer (repellent face) is not limited thereto. Alternatively, the partition 57 may be made of a resin repellent to developer or metal repellent to developer. Yet alternatively, the partition 57 may be coated with a substance repellent to developer by dip molding or immersion.

Additionally, the guide face 57*a* is inclined but flat. The flat face is advantageous in that developer is not retained due to the surface shape of the guide face 57*a* and the developer-repellent sheet is easily attached to the guide face 57*a*.

The above-described first embodiment and the first through fourth variations concern the repellent face 90 provided to the developer conveyor disposed in the developing device 5, 150, or 200 (collectively "developing device 5"), and the fifth and sixth variations concern the repellent sheet 91 provided to the face defining the developer conveyance passage inside the developing device 5. In another variation, both of the developer conveyor and the face defining the developer conveyance passage inside the developing device 5 include the faces repellent to developer. This configuration is advantageous in reducing the number of portions to which developer firmly adheres and better inhibiting firm adhesion of developer inside the developing device for a long time. Accordingly, even with the developer degraded with time, the occurrence of image failure is inhibited, and it is not necessary to scrape off developer from the developer conveyor and the face defining the developer conveyance passage.

In the above-described first embodiment and the first through fourth variations, all developer conveyors disposed in the developing device 5 include the repellent faces 90. However, in the developing device 5 including the multiple developer conveyors, firm adhesion of developer in the developing device 5 is inhibited by providing the repellent face 90 to at least one of the multiple developer conveyors. Thus, such a configuration is preferable similarly.

In the above-described first embodiment and the first through fourth variations, the faces of the entire shaft extending axially and the entire screw blade are made repellent to developer (i.e., the repellent faces 90). In another variation, the repellent face 90 is formed in a part of the developer conveyor in the axial direction. For example, the repellent face 90 is formed in a portion to transport collected developer since the collected developer is degraded by being used in image development. This configuration is preferable similarly since firm adhesion of developer in that portion is inhibited.

In the fifth and sixth variations, the repellent sheet 91 is provided to the guide face 57*a* as the face defining the developer conveyance passage inside the developing device 5. However, the portion made repellent to developer is not limited thereto. For example, in another variation, the repellent faces 91 are provided to communicating portions to connect together ends of the multiple developer conveyance compartments to circulate developer through the multiple developer conveyance compartments. This configuration can inhibit firm adhesion of developer inside the developing device.

The faces inside the casing that contact developer can be made repellent to developer by forming a developer-repellent layer thereon with a developer-repellent substance. As another method, the portion inside the casing that contacts developer is made of a developer-repellent material. That is, the method of making the portion repellent to developer is not limited to surface treatment or surface processing but include forming or molding that portion using a developer-repellent material.

Second Embodiment

Figure 14:
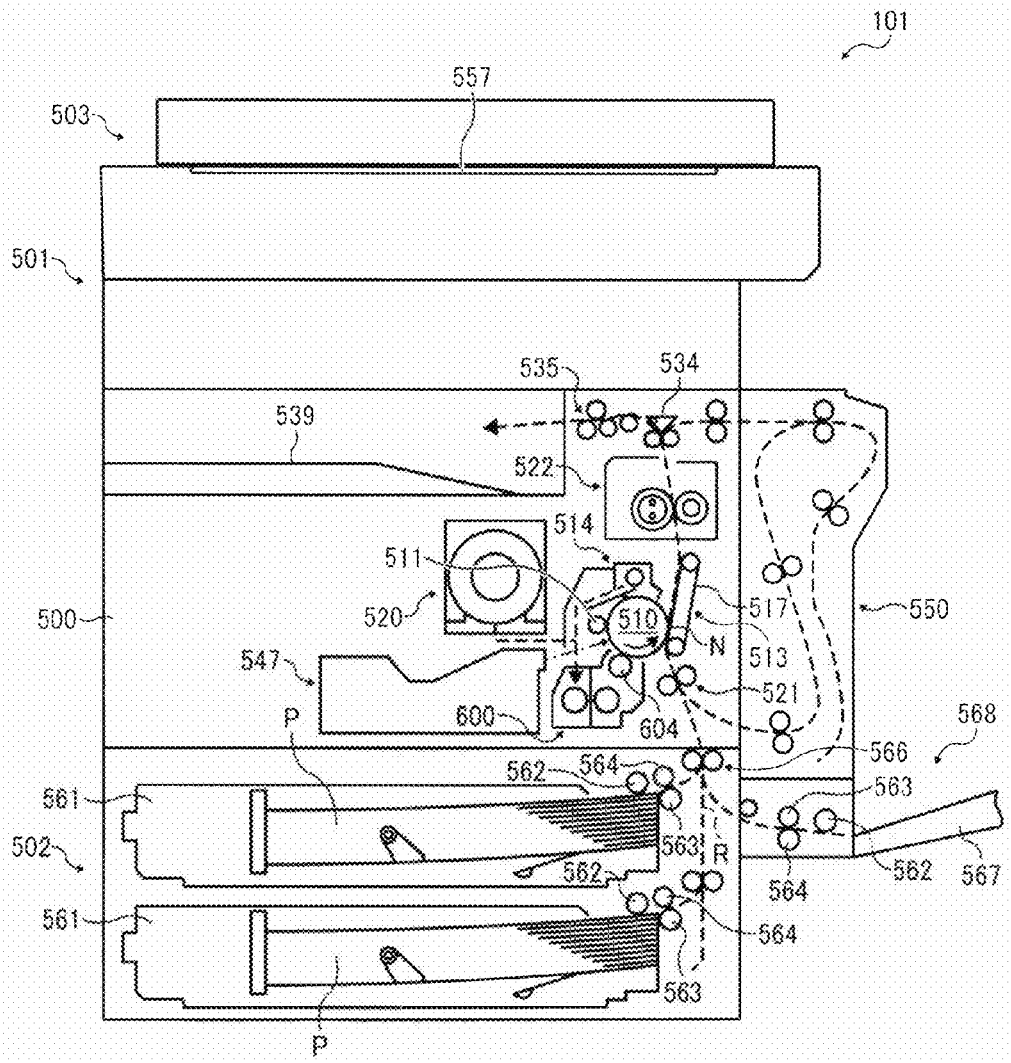
FIG. 14 a schematic is view of an image forming apparatus including a developer collecting device according to a second embodiment.

A second embodiment is described below with reference to FIGS. 14, 15, and 16. In the present embodiment, repellency to developer is given to a collected-developer passage. Referring to FIG. 14, descriptions are given below of a configuration and operation of an image forming apparatus 101 incorporating the collected-developer passage.

The image forming apparatus 101 illustrated in FIG. 14 is a monochrome copier, for example. The image forming apparatus 101 includes an apparatus body 500 placed on a sheet bank 502. Above the apparatus body 500, a scanner 501 (i.e., an image reading device) is provided. The scanner 501 includes an exposure glass 557 on which a document is placed, and an automatic document feeder (ADF) 503 is disposed above the scanner 501. The ADF 503 can be lifted to open.

Inside the apparatus body 500, a photoconductor drum 510 serving as an image bearer is disposed. The photoconductor drum 510 extends perpendicularly to the surface of the paper on which FIG. 14 is drawn. A charging device 511 is disposed on the left of the photoconductor drum 510, and a developing device 600, a transfer device 513, and a cleaning device 514 are arranged in that order in the direction of rotation of the photoconductor drum 510, which is counterclockwise in FIG. 14.

The developing device 600 includes a developing roller 604 serving as a developer bearer to supply developer to an electrostatic latent image on the photoconductor drum 510 to develop the electrostatic latent image into a visible image. The transfer device 513 includes a transfer belt 517 entrained around rollers arranged vertically and serves as both of an image bearer and an intermediate transfer member. The transfer belt 517 is pressed to contact the circumferential face of the photoconductor drum 510 at a transfer position N. A toner supply device 520 is disposed on the side of the charging device 511 and the cleaning device 514 and supplies fresh toner to the developing device 600. On the left of the developing device 600 in FIG. 14, a laser writing device 547 to emit exposure light is disposed.

Inside the apparatus body 500, a sheet feed path R is defined by conveying rollers and sheet guides to transport a sheet P fed from sheet trays 561 (stacked in multistage manner) of the sheet bank 502. The sheet feed path R extends upward to the transfer position N and further to a sheet stack section 539. A pair of registration rollers 521 is provided upstream from the photoconductor drum 510 in the sheet feed path R.

A fixing device 522 is disposed downstream from the photoconductor drum 510. Downstream from the fixing device 522, a bifurcating claw 534 and a pair of ejection rollers 535 are disposed. The sheet stack section 539 to store the sheet P on which an image is recorded is positioned downstream from the ejection rollers 535.

A switchback device 550 is disposed on a face of the apparatus body 500 on the right in FIG. 14. In duplex printing, the switchback device 550 reverses the sheet P carrying an image fixed on one side thereof and guides the sheet P again to the transfer position N.

The sheet trays 561 are stacked one on another in the sheet bank 502 to store sheets P of recording media such as paper and overhead projector (OHP) transparencies. Each of the sheet trays 561 is provided with a pickup roller 562, a feed roller 563, and a separation roller 564. The multistage sheet trays 561 are connected with the sheet feed path R.

The apparatus body 500 is provided with a multi-purpose feed section 568 positioned below the switchback device 550. The multi-purpose feed section 568 includes a multi-purpose tray 567, which is openable and closable. The sheets P placed on the multi-purpose tray 567 is led to the sheet feed path R. The multi-purpose tray 567 is provided with the pickup roller 562, the feed roller 563, and the separation roller 564 similarly.

Image forming operations of the image forming apparatus 101 are described below.

It is assumed that a document is set on the exposure glass 557. When a user presses a start button, the scanner 501 is activated to read the image data of the document. Simultaneously, the photoconductor drum 510 is driven by a photoconductor driving motor, and the charging device 511 including a charging roller charges the surface of the photoconductor drum 510 uniformly. Then, the laser writing device 547 directs a laser beam onto the surface of the photoconductor drum 510 according to the document scanned by the scanner 501, thus forming an electrostatic latent image on the photoconductor drum 510. The electrostatic latent image is developed with toner included in the developer supplied by the developing device 600.

When the start button is pressed, the pickup roller 562 picks up the sheet P from selected one of the multistage sheet trays 561 of the sheet bank 502. The sheet P is separated one by one from the rest and fed to the sheet feed path R by the feed roller 563 and the separation roller 564. The sheet P is transported along the sheet feed path R by conveyance rollers 566 and stopped by the registration rollers 521. The registration rollers 521 forward the sheet P to the right of the photoconductor drum 510, timed to coincide with arrival of the visible toner image on the photoconductor drum 510. To use the multi-purpose feed section 568, the multi-purpose tray 567 is opened. The pickup roller 562 picks up the sheet P set on the multi-purpose tray 567, and the feed roller 563 and the separation roller 564 separate the sheet P from the rest and feed the sheet P one by one to the sheet feed path R. The registration rollers 521 forward the sheet P to the right of the photoconductor drum 510, timed to coincide with rotation of the photoconductor drum 510.

Then, the transfer device 513 transfers the toner image onto the sheet P from the photoconductor drum 510 at the transfer position N. The cleaning device 514 removes toner remaining on the photoconductor drum 510 after image transfer, and a discharger removes residual potential from the photoconductor drum 510. Then, the apparatus is prepared for subsequent image formation started by the charging device 511.

Meanwhile, the transfer belt 7 transports the sheet P carrying the toner image to a fixing device 522, where the toner image is fixed on the sheet P with heat and pressure. Subsequently, the sheet P is discharged to the sheet stack section 539 by the ejection rollers 535.

It is to be noted that, in duplex printing, the position of the bifurcating claw 534 is changed, and the sheet P carrying the image is guided from the sheet feed path R into the switchback device 550. The sheet P is turned upside down, and transported again through the sheet feed path R to the transfer position N, where an image is transferred onto a back side of the sheet P in a manner similar to the manner described above.

Next, referring to FIGS. 15 and 16, descriptions are given below of configurations of the developing device 600 and supply of toner to the developing device 600.

The developing device 600 includes the developing roller 604 and spiral-shaped conveying screws 601 and 602 serving as developer conveyors. Two-component developer G including toner and carrier is supplied to the developing roller 604 while the conveying screws 601 and 602 transport the developer G in the direction perpendicular to the surface of the paper on which FIG. 15 is drawn. Specifically, defined inside the developing device 600 are conveyance compartments 611 and 612 extending in the direction perpendicular to the surface of the paper on which FIG. 15 is drawn. The conveying screw 601 is supported rotatably inside the conveyance compartment 611 and transports developer G from the back side to the front side of the paper on which FIG. 15 is drawn. The conveying screw 602 is supported rotatably inside the conveyance compartment 612 and transports developer G from the front side to the back side of the paper on which FIG. 15 is drawn. The conveyance compartment 611 communicates with the conveyance compartment 612 at both ends in the longitudinal direction of the conveyance compartments 611 and 612 (axial direction of the conveying screws 601 and 602), which is perpendicular to the surface of the paper on which FIG. 15 is drawn, and the developer G transported by the conveying screws 601 and 602 is circulated between the conveyance compartments 611 and 612.

In the conveyance compartment 611, the developing roller 604 is disposed parallel to the conveying screw 601. The developer G transported by the conveying screw 601 is scooped up magnetically by the developing roller 604, which rotates clockwise in FIG. 15 and contains a magnet. Then, a developer doctor 607 adjusts the amount of developer G scooped magnetically while charging the developer G with friction. The charged developer G stands on end on the developing roller 604 at a main pole which is greatest in magnetic strength among multiple magnetic poles of the developing roller 604. Then, the developer G contacts the surface of the photoconductor drum 510. A bias voltage is applied to the developing roller 604, and toner adheres selectively to the surface thereof according to the electrostatic latent image.

The photoconductor drum 510, the charging device 511 to charge the photoconductor drum 510 uniformly, a cleaning blade 541 of the cleaning device 514 to clean the photoconductor drum 510, and a conveying screw 542 (i.e., a collected-toner conveying screw), which transports toner T1 collected (hereinafter "collected toner T1") by the cleaning blade 541 to a collected-toner conveyance passage 590 (illustrated in FIG. 16), are united together as a process cartridge 650. The process cartridge 650 is removably installable in the apparatus body 500 illustrated in FIG. 14 so that components thereof are easily replaceable as required. The process cartridge 650 is removable and installable in the apparatus body 500 either in a state united with the developing device 600 or independently from the developing device 600. The process cartridge 650 and the developing device 600 are united into a process cartridge unit.

Figure 15:
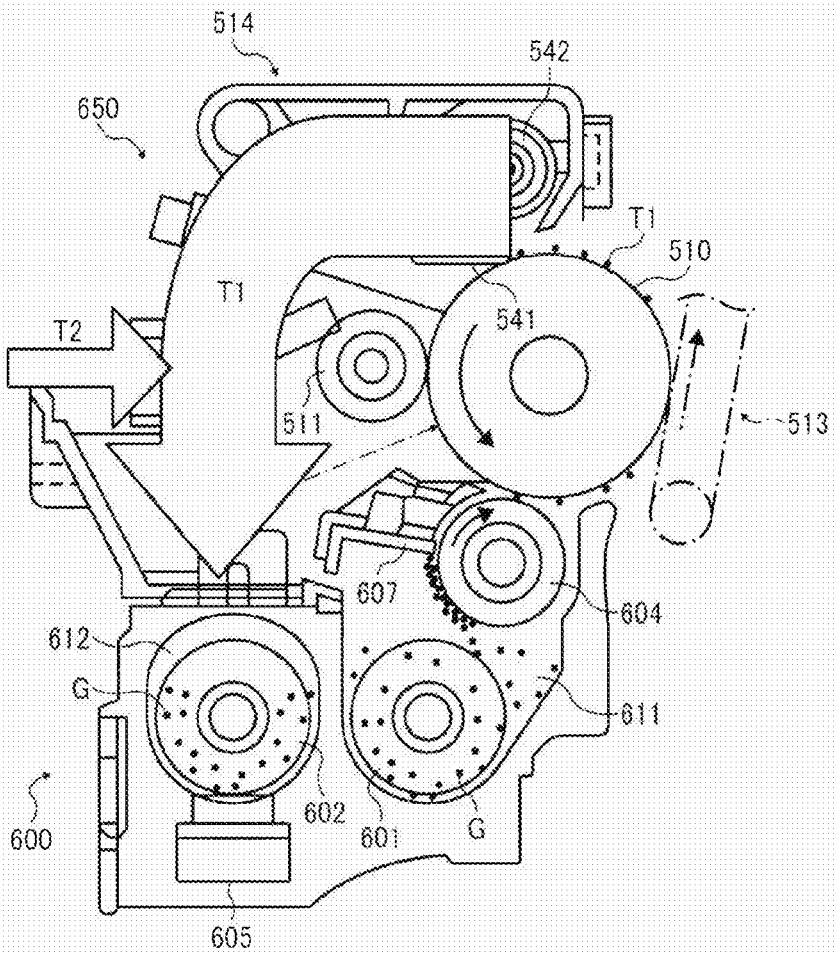
FIG. 15 illustrates flow of developer from a cleaning device into a developing device in the configuration illustrated in FIG. 14.

The developing device 600 illustrated in FIG. 15 includes a toner density sensor 605 to detect density of toner or ratio of toner in developer G inside the developing device 600. When a value detected by the toner density sensor 605 deviates from a target value (threshold) or range, the toner supply device 520 illustrated in FIG. 14 supplies toner to the developing device 600 to keep the toner concentration in a desired range.

In the present embodiment, the collected toner T1 (residual toner after transfer) is returned to the developing device 600 for reuse or recycling, an operation for which is referred to as "toner recycling operation"). That is, the collected toner T1 is intermittently returned to the developing device 600. Accordingly, during image formation, it is preferred to detect the toner concentration, for example, after elapse of predetermined time subsequent to the toner recycling operation so that uneven toner concentration is presumably resolved.

Similarly, to determine whether to supply fresh toner T2 from the toner supply device 520, it is preferred to detect the toner concentration after elapse of predetermined time subsequent to the toner recycling operation so that uneven toner concentration is presumably resolved.

In the present embodiment, the process cartridge unit (or the image forming apparatus 101) includes a developer collecting device 700 to return the collected toner T1 collected by the cleaning device 514 to the developing device 600. The developer collecting device 700 includes the conveying screw 542 to transport the collected toner T1 and a collected-toner conveyance passage 590 in which the conveying screw 542 is disposed. The collected-toner conveyance passage 590 is connected to the cleaning device 514 as well as the developing device 600. The collected-toner conveyance passage 590 can be formed with conduits and the shape is not necessarily cylindrical but can be polygonal or square.

The collected-toner conveyance passage 590 extends in the axial direction of the photoconductor drum 510 and includes a first conveyance passage 591, where the conveying screw 542 is disposed, a second conveyance passage 592 connected to an end of the first conveyance passage 591 on the front side of the apparatus, and a third conveyance passage 593 (in FIG. 17A) to connect the second conveyance passage 592 with the developing device 600. In the present embodiment, the first conveyance passage 591 is substantially horizontal. The second conveyance passage 592 is inclined down from the first conveyance passage 591 to the third conveyance passage 593. The third conveyance passage 593 is substantially vertical.

The toner recycling operation is to return the collected toner T1, which remains on the photoconductor drum 510 after the transfer process, to the developing device 600. Specifically, the collected toner T1, remaining on the photoconductor drum 510 after the transfer process, is collected from the photoconductor drum 510 by the cleaning blade 541 and transported by the conveying screw 542. Then, the collected toner T1 is transported through the collected-toner conveyance passage 590 illustrated in FIG. 16 and supplied, from above, to an end 612*a* of the conveyance compartment 612 of the developing device 600. Thus, the collected toner T1 is returned to the developing device 600.

Figure 16:
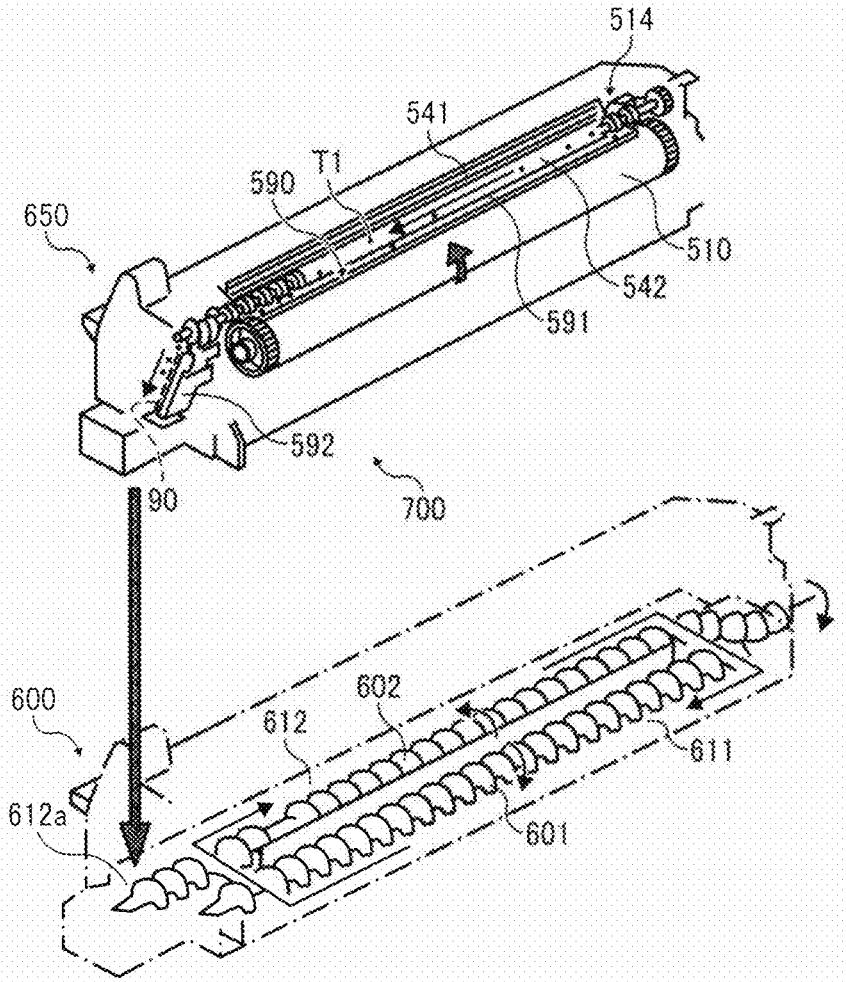
FIG. 16 is a perspective view of a developer collecting section according to the second embodiment.

Specifically, as illustrated in FIG. 16, the conveying screw 542 transports the collected toner T1, which is scrapped off by the cleaning blade 541, through the first conveyance passage 591 along the axial direction of the photoconductor drum 510 to the front side of the apparatus. Then, the collected toner T1 is transported through the second conveyance passage 592 and the third conveyance passage 593 and returned to the developing device 600 for reuse in the developing process. The fresh toner T2 from the toner supply device 520 (illustrated in FIG. 14) is supplied to the third conveyance passage 593.

In the present embodiment, in recovering from the end of toner, the developing roller 604 and the conveying screws 601 and 602 are rotated to mix the supplied toner (fresh toner T2) with the developer G. It is preferred that the photoconductor drum 510 be rotated so that rotation of those components does not result in uneven sliding of developer G on the developing roller 604.

Incidentally, in electrophotographic image forming apparatuses, as described above, a certain amount of toner remains on the image bearer after the toner image is transferred therefrom onto a sheet or the intermediate transfer belt. There are other causes to allow excess toner (except the toner used in image formation) to adhere to the photoconductor. For example, there may be timing errors in bias application (the charging bias to the image bearer and the developing bias to the developing range) at the start and end of printing. Toner can adhere to a range where the charging potential on the photoconductor is unstable until the apparatus is stabilized at start up, and unstably charged toner can adhere to the background area of the photoconductor. Typically, the untransferred toner (excess toner) is removed from the photoconductor by the cleaning device. In the present embodiment, the cleaning device 514 removes the collected toner T1 from the photoconductor drum 510.

The untransferred toner may be stored in a waste toner tank and discarded in maintenance work. Alternatively, for running cost reduction and environmental consciousness, the untransferred toner is collected and reused. The image forming apparatus 101 according to the present embodiment includes the collected-toner conveyance passage 590 to return the collected toner T1 collected by the cleaning device 514 to the developing device 600. In particular, in direct transfer systems like the image forming apparatus 101 according to present embodiment, in which the intermediate transfer member is not used and toner is transferred directly from the photoconductor drum 510 onto the sheet P, the cleaning device 514 collects not only the collected toner T1 but also paper dust and the like adhering to the photoconductor drum 510 due to contact between the photoconductor drum 510 and the sheet P.

After the fresh toner T2 is supplied from the toner supply device 520, the collected toner T1 is given stress at each stage of stirring in the developing device 600, image development on the photoconductor drum 510, image transfer, and collection by the cleaning device 514. Additionally, due to its mechanical structure, the cleaning device 514 is disposed downstream from the transfer position N in the direction of rotation of the photoconductor drum 510. In some cases, the cleaning device 514 is relatively close to the fixing device 522, which is disposed downstream from the transfer position N similarly. In this case, the collected toner T1 is exposed to heat, and wax in or on the collected toner T1 may melt, resulting in decreased flowability and increased possibility of aggregation. The aggregation tends to increase in size as paper dust collected together adheres to the aggregation. Importance of this problem is increasing since use of developer having lower melting point is currently promoted to reduce impact on environment.

If such a state repeatedly occurs or the apparatus is left unused for long time, toner is degraded and can adhere to or solidify inside the collected-toner conveyance passage 590 including the interior of the cleaning device 514. A part of such toner adhesion or solidification becomes dead toner that is not transported by rotation of the conveying screw 542. Additionally, the collected toner T1 may accumulate on wall faces of the conveyance passage or the developer conveyors or gaps between screw pitches and gaps between the conveying screw 542 and the wall face. Such accumulating toner can adhere to the wall faces of conveyance passage or the developer conveyors or solidify there as dead toner. The dead toner can cause overflow of toner or toner spill, thus soiling the interior of the apparatus body 500.

It is possible that the dead toner falls from the face of the collected-toner conveyance passage 590 or the conveying screw 542 upon vibration of the process cartridge 650, the developing device 600, or the apparatus body 500. The vibration arises when the process cartridge 650 is removed or installed by a service person, the sheet tray 561 is opened or closed, the ADF 503 is opened or closed, and the apparatus is moved.

As the conveying screw 542 rotates, the collected toner T1 falling to the collected-toner conveyance passage 590 enters the developing device 600. If a large amount of toner is supplied to the developing device 600 in a short period, insufficiently charged toner is used in development and causes background fog, or toner fall due to paper dust.

In particular, currently, there is long-life developer usable for long time, with a small usage amount, and the mount of developer contained in the developing device is decreasing. In the image forming apparatus including such a developing device, even when the amount of toner mixed is the same, the effect is greater relative to the developing device in which a larger amount of developer is contained.

In view of the foregoing, in the second embodiment, at least one of the conveying screw 542 and the collected-toner conveyance passage 590 includes the face repellent to toner, similar to that according to the first embodiment. In other words, the surface of the portion that contacts the collected toner (reused toner) is made repellent to toner.

Figure 17B:
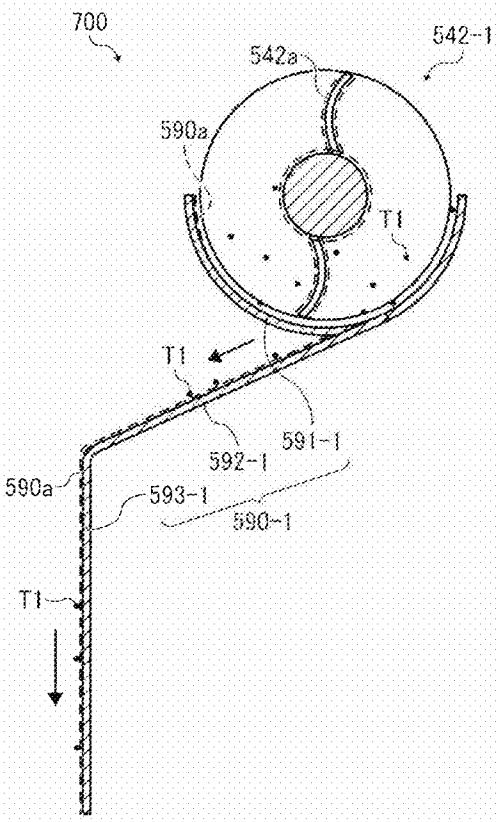
FIGS. 17A and 17B are enlarged perspective views illustrating flow of developer in the developer collecting section according to the second embodiment.
Figure 17A:
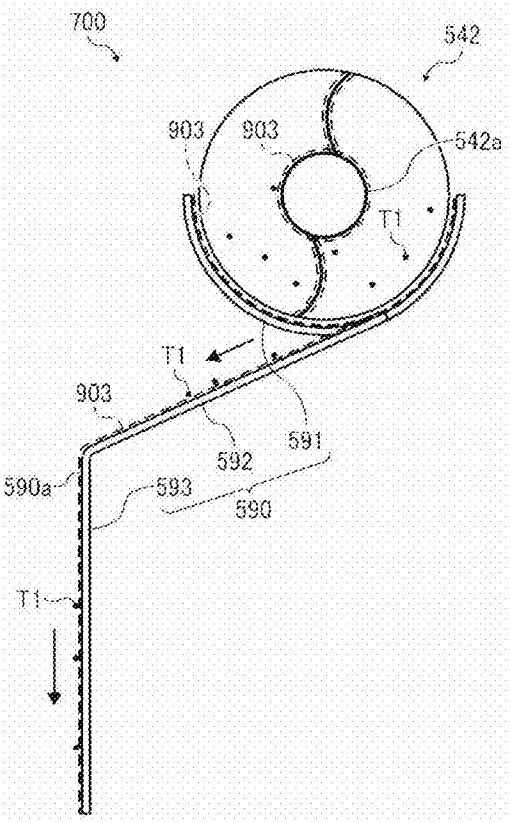

In FIGS. 17A and 17B, reference characters 542*a* represents the face of the conveying screw 542, and 590*a* represents the wall face of the collected-toner conveyance passage 590. The faces 542*a* and 590*a* or portions that contact the collected toner T1 can be made repellent to toner by forming a toner-repellent layer 903 thereon with a toner-repellent substance or forming a nano-size surface roughness pattern on the surfaces to contact the collected toner T1.

As another method, at least one of the collected-toner conveyance passage 590 and the conveying screw 542 are made of a toner-repellent material. In FIG. 17B, the developer collecting device 700 includes a conveying screw 542-1 made of a toner-repellent material and a collected-toner conveyance passage 590-1 (including first, second, and third conveyance passage 591-1, 592-1, and 593-1) made of a toner-repellent material. As a result, the wall face 590*a* of the collected-toner conveyance passage 590-1 and the face 542*a* of the conveying screw 542-1 are made repellent to toner. That is, the method of making a face or a component repellent to toner is not limited to surface treatment or surface processing but include forming or molding that component using a toner-repellent material.

When repellency to toner is given to the face 542*a* of the conveying screw 542, the collected toner T1 is inhibited from adhering to the conveying screw 542. Accordingly, the capability to transport the collected toner T1 (reused toner) is maintained even when the apparatus is used under hot and humid conditions or low image area image is successively formed using degraded toner having reduced flowability and additive buried therein.

Additionally, even when the apparatus body 500 is vibrated, the collected toner T1 does not fall off the conveying screw 542. Accordingly, this configuration can avoid the inconvenience that a large amount of the collected toner T1 is mixed in the developing device 600 by rotation of the conveying screw 542 immediately after the vibration.

By contrast, when repellency to toner is given to the wall face 590*a* of the collected-toner conveyance passage 590, the collected toner T1 is less likely to adhere to the gaps and solidify there. The gaps are situated, inside the collected-toner conveyance passage 590, at positions where the conveying screw 542 does not contact during rotation. Additionally, even when the apparatus body 500 is vibrated, the collected toner T1 does not fall off the wall face 590*a*. Accordingly, this configuration can avoid the inconvenience that a large amount of the collected toner T1 is mixed in the developing device 600 by rotation of the conveying screw 542 immediately after the vibration.

[Developer Repellency]

Next, descriptions are given to evaluation of developer repellency or toner repellency, which is common to the first and second embodiments.

For the evaluation, test runs were executed using the comparative examples, the developing device 5 according to the first embodiment, and the conveying screw 542 and the collected-toner conveyance passage 590 according to the second embodiment. Developer repellency or toner repellency is given to respective components with the materials described below. After elapse of time after the test run, adhesion of developer was observed.

The test run using the configuration according to the first embodiment was executed under hot and humid conditions, temperature of 27° C. and relative humidity (RH) of 80%, which are likely to cause firm adhesion of developer, and a low image area image (smaller in the amount of toner replaced) was output on 200,000 sheets.

The test run using the configuration according to the second embodiment was conducted under hot and humid conditions, temperature of 27° C. and relative humidity (RH) of 80%, which are likely to cause adhesion of toner similarly, and, to cause a higher degree of toner degradation, in midway of forming a low image area images on 200,000 sheets, a unit including the developing device 600 and the process cartridge 650 was removed each time the number of output sheets reached 50,000. The unit was disassembled presuming developer replacement and assembled again. After the unit was tilted and given vibration, the unit was installed again in the image forming apparatus. Then, reference images were output, and background fog and toner fall were checked.

Followings are properties of developer-repellent faces tested, and positions where the developer-repellent faces are provided. Configurations 1 through 4 are according to the embodiments of the present invention.

Comparative Example 1

Polycarbonate (PC) plus acrylonitrile-butadiene-styrene (ABS) resin: Used for the developing device itself used in the evaluation. The casing of the developing device, the conveying screws (e.g., the conveying screws 53 and 54 or the conveying screws 601 and 602), the conveying screw 542 (collected-toner conveying screw), and the collected-toner conveyance passage 590 (the casing of the process cartridge) were produced by injection molding using the PC plus ABS resin.

Comparative Example 2

Polycarbonate: Components were coated, by dipping, with polycarbonate used as a charge transport layer of photoconductors for electrophotography.

Comparative Example 3

Nano glasscoat: Coating having three-dimensionally linked siloxane skeleton, which has high repellency to water and oil. Components were coated with nano glasscoat nano from Glasscoat JAPAN Inc., by dipping.

(Configurations 1 and 2)

TOYAL LOTUS™ from Toyo Aluminium K.K. was bonded via an adhesive layer to the components. TOYAL LOTUS™ is water repellent and has minute (nano size) projections and recesses on the surface (rough surface).

(Configuration 3)

Components were coated with NeverWet® from RUST-OLEUM®. NeverWet® is a spray coating that forms minute projections and recesses on the surface and exhibits high water repellency.

(Configuration 4)

Nanoimprint film: Nanoimprint is a molding technique in which a mold is pressed to a target, which can be softened thermoplastic resin, glass, or ultraviolet (UV) curable resin in liquid form. A shape attained by nanoimprint has surface roughness reversed to the surface roughness of the mold. Although nanoimprint requires a mold processed with a high accuracy, once a mold is produced, nano-size processing is available through simple processes similar to those of pressing.

Nanoimprint is roughly classified into thermal nanoimprint and optical nanoimprint. In thermal nanoimprint, a mold is pressed to thermally softened resin to deform the resin, the resin is cooled below its softening point for solidification, and the mold is removed from the resin. Thus, the shape is transferred to the resin. In optical nanoimprint, a mold is pressed to UV curable resin in liquid form to fill a clearance between the mold and a substrate with the resin, the resin is solidified by, for example, irradiation with ultraviolet, and the mold is removed from the resin. Thus, the shape is transferred to the resin.

In the embodiments, for example, nanoimprint film having a moth-eye structure with a pitch of about 200 nm and a height of 150 nm was boned via an adhesive layer to components (such as the conveying screws and the guide face 57*a*) of the developing device, the wall face 590*a* of the collected-toner conveyance passage 590, and the face 542*a* of the conveying screw 542.

It is to be noted that the method of applying nanoimprint to the developing device is not limited thereto. Alternatively, the mold for the developing device may be processed with high accuracy to have nano-size surface roughness so that the nano-size surface roughness is transferred to the resin molded into the part of the casing that contacts developer or the conveying screws. The methods of forming nano-size surface roughness are not limited to the examples described above.

Table 1 shows surface roughness of the materials according to Comparative examples 1 through 3 (C1 through C3 in Table 1) and Configurations 1 through 4 (E1 through E4 in Table 1), ratings of developer adhesion over time tested using the first embodiment, and ratings of background fog and toner fall tested using the second embodiment. In Table 1, developer adhesion in the configuration according to the first embodiment, evaluated after elapse of time, background fog and toner fall evaluated using the second embodiment are rated in three levels. The degree of developer adhesion, background fog, and toner fall were rated as one of "poor" meaning substandard, "acceptable", and "good" better that "acceptable".

To measure surface roughness Ra, a contact-type surface roughness meter, SURFCOM1400D from TOKYO SEIMITSU CO., LTD., was used. Measurement was executed with length and cutoff according to JIS (Japanese Industrial Standards) B0601:'01.

To measure the surface roughness Ra, a scanning probe microscope system, SPA400, from Seiko Instruments Inc., was used. After a sample area of 10 $\mu m^2$ was scanned in dynamic force mode (DFM) as tapping mode, inclination was corrected, and measurement was executed with a measurement length of 2 μm, without cutoff. Since typical toner particle diameter for electrophotographic image forming apparatuses is 2 μm to 10 μm, it is assumed that the measurement length of 2 μm is sufficient for considering the interface of contact between the toner and the material. Then, the surface roughness can be measured in the minute range that contacts toner. Each measured value in Table 1 is an average of ten times of measurement at different positions.

Figure 19A:
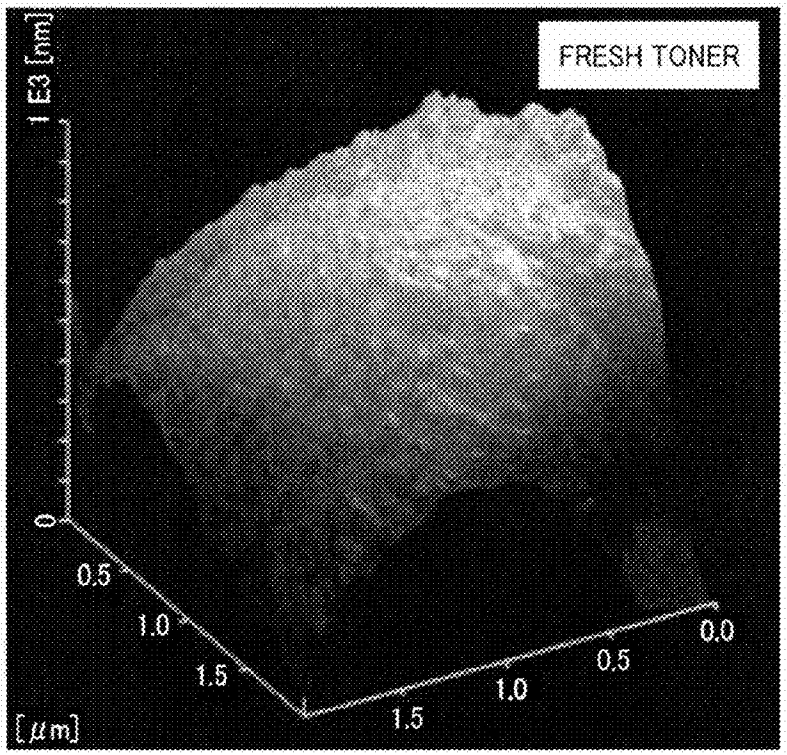
FIG. 19A is a view of fresh toner (initial toner) observed by a scanning probe microscope (SPM)
Figure 19B:
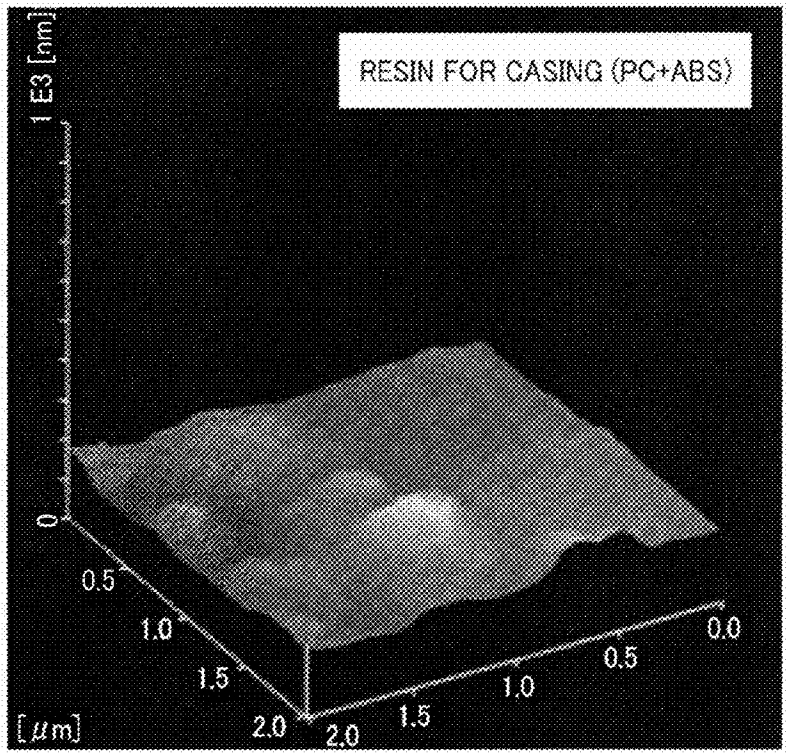
FIGS. 19B through 19H are views of surfaces observed by the SPM in evaluation of developer repellency.
Figure 19C:
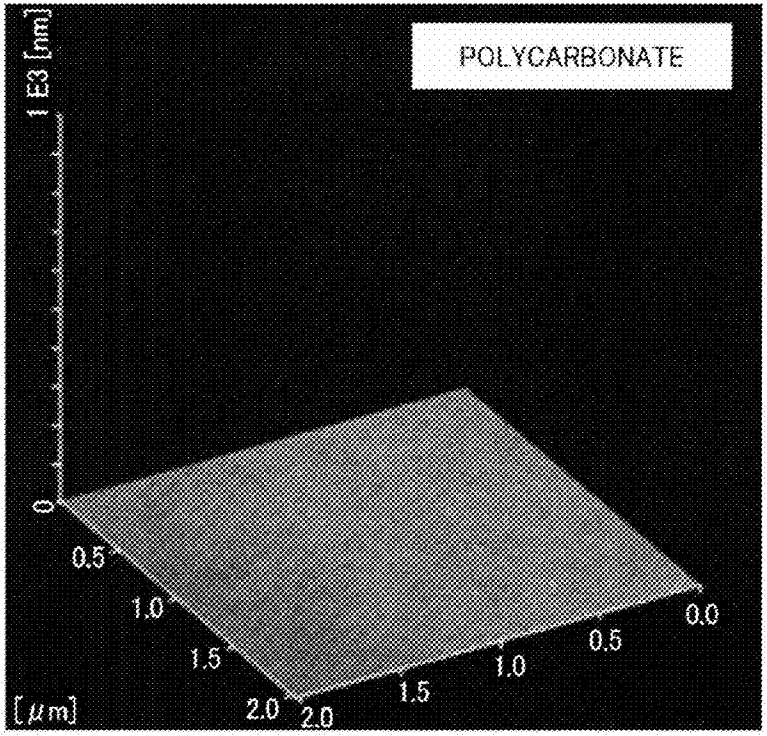
Figure 19D:
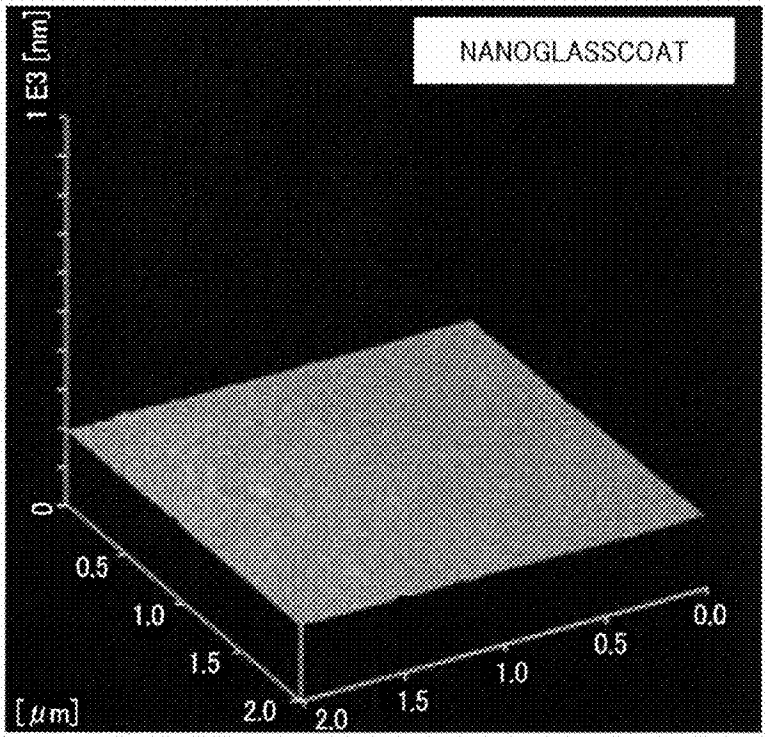
Figure 19E:
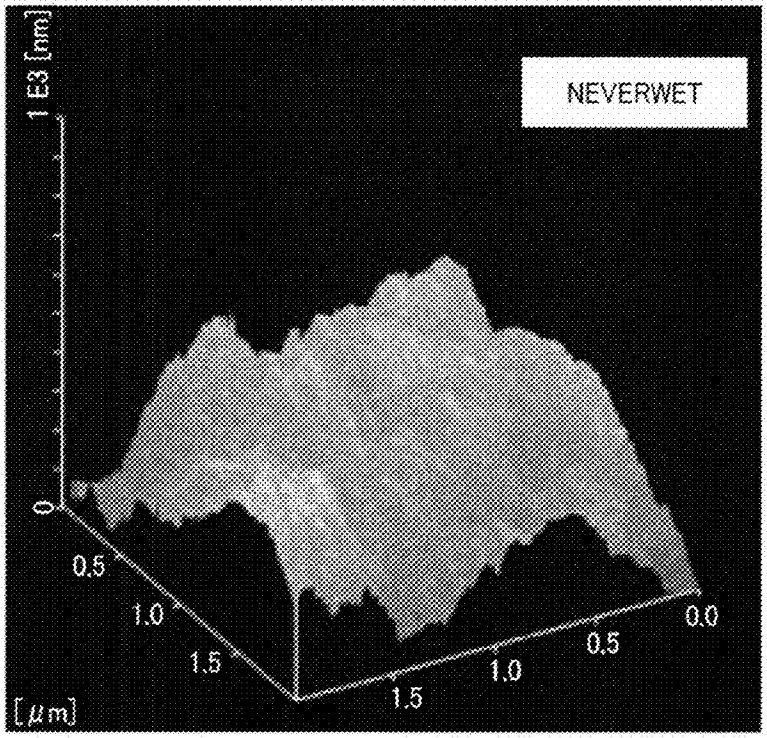
Figure 19F:
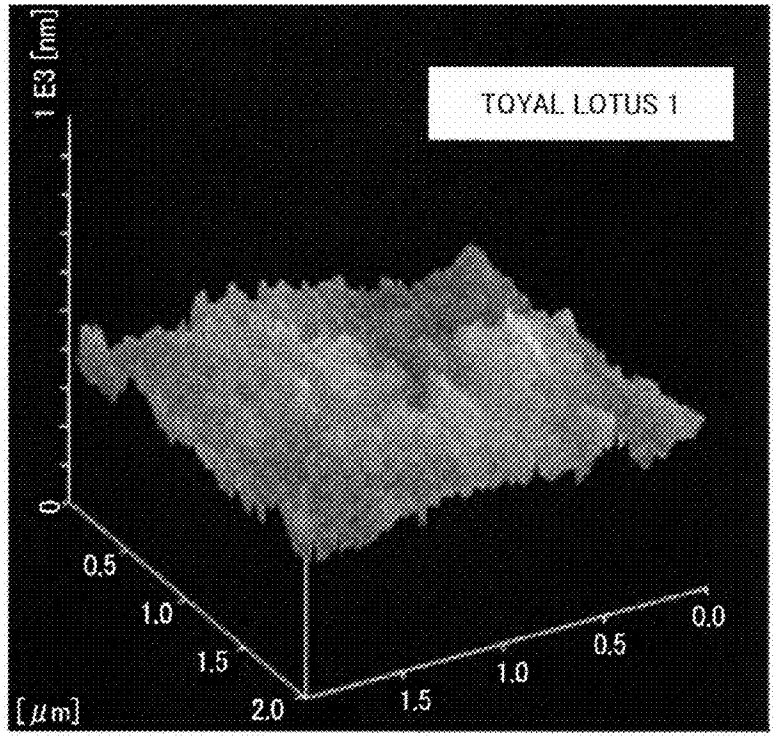
Figure 19G:
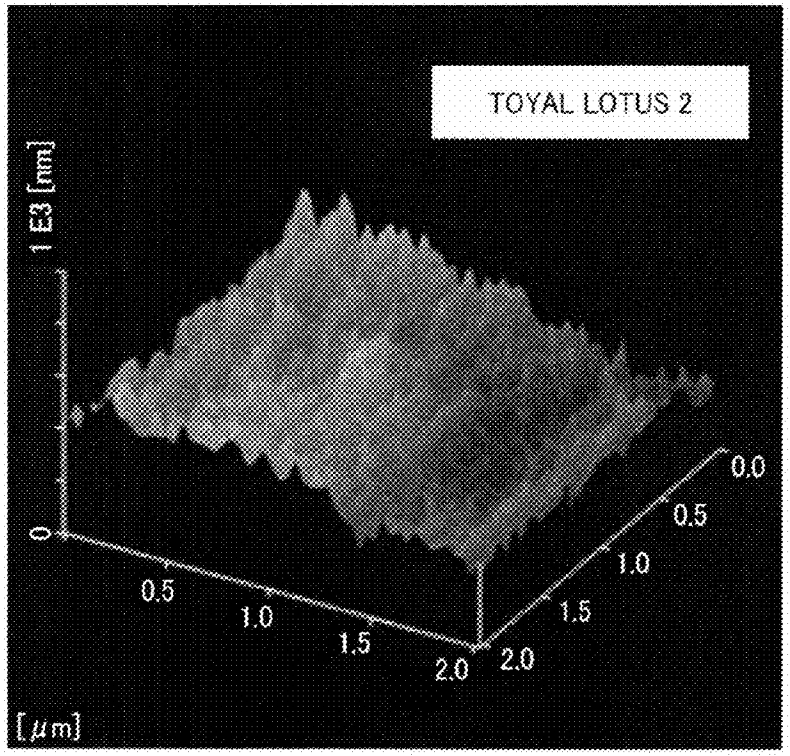
Figure 19H:
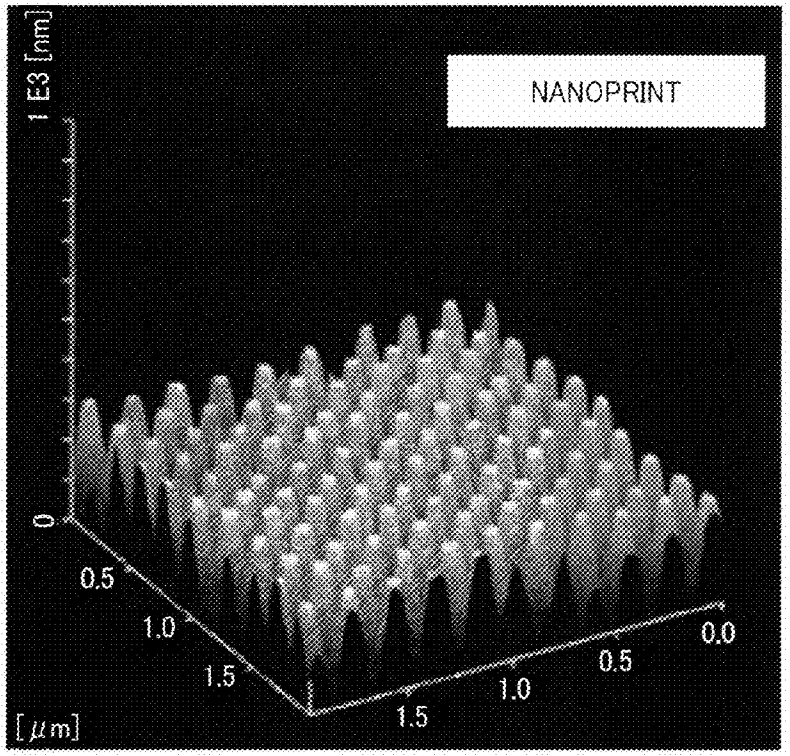

FIG. 19A is a view of fresh toner (initial toner) observed by the scanning probe microscope (SPM). FIG. 19B through 19H are views of the above-described surfaces observed by the SPM.

TABLE 1

| Material | Ra (μm) by contact-type surface roughness meter | Ra (nm) by SPM | Developer adhesion over time in First embodiment | Background fog and toner fall in Second embodiment |
|---|---|---|---|---|
| C1 PC + ABS | 0.09 | 16.1 | Poor | Poor |
| C2 PC | 0.01 | 0.16 | Poor | Poor |
| C3 Nano glasscoat | 0.13 | 1.05 | Poor | Poor |
| E1 TOYAL LOTUS 1 | 20.0 | 25.6 | Acceptable | Acceptable |
| E2 TOYAL LOTUS 2 | 4.0 | 45.0 | Good | Good |
| E3 NeverWet | 4.3 | 39.6 | Good | Good |
| E4 Nanoimprint | 0.02 | 41.6 | Good | Good |

Referring to Table 1, in which the degree of surface roughness Ra and adhesion after the test runs are shown, adhesion of developer evaluated after elapse of time is inhibited preferably in the rage of surface roughness Ra according to the embodiments.

In Configuration 1 using TOYAL LOTUS 1, developer adhered to inclined faces, such as the guide face 57*a* illustrated in FIGS. 12 and 13 and the second conveyance passage 592 of the collected-toner conveyance passage 590 illustrated in FIG. 16.

Figure 18A:
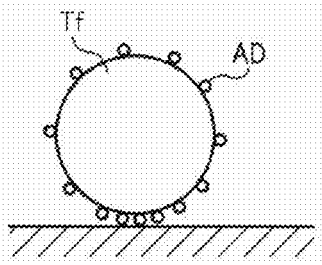
FIG. 18A illustrates a fresh toner particle on a smooth surface.
Figure 18B:
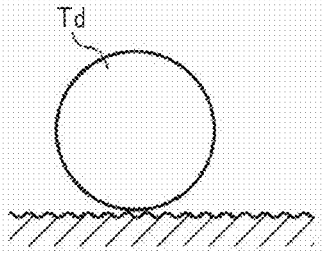
FIG. 18B illustrates a degraded toner particle on a surface having minute roughness.
Figure 18C:
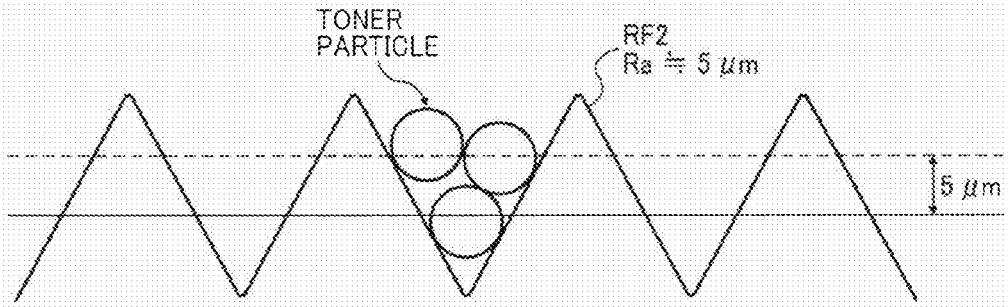
FIG. 18C is a schematic view of toner particles on a surface having a surface roughness Ra of 5 μm.

FIGS. 18A, 18B, and 18C schematically illustrate the relation between toner particles and surface roughness.

FIG. 18A illustrates a fresh toner particle Tf on a smooth surface. Reference character AD represents external additives. FIG. 18B illustrates a degraded toner particle Td on a surface having minute roughness. FIG. 18C is a schematic view of toner particles on a rough surface RF2 having a surface roughness Ra of 5 μm. If there are projections and recesses sufficient in size to catch toner particles on the surface as illustrated in FIG. 18C, toner particles are retained and solidify on the inclined faces, such as the guide face 57*a* illustrated in FIGS. 12 and 13, where developer flows down. By applying the material having a surface roughness Ra smaller than 5 μm, measured by the contact-type surface roughness meter, to such portions, firm adhesion of developer can be inhibited. Additionally, according to the evaluation executed by the inventors, firm adhesion of degraded developer is inhibited by use of a material having minute surface roughness, such as Configuration 4 illustrated in FIG. 18B.

In the second conveyance passage 592 having the inclined face, if there are projections and recesses sufficient in size to catch toner particles as illustrated in FIG. 18C, toner is retained there. Upon application of vibration, adhering toner thuds down from the second conveyance passage 592. Then, a large amount of reused toner is supplied. By applying the material having a surface roughness Ra smaller than 5 μm, measured by the contact-type surface roughness meter, to such inclined portions, toner is inhibited from accumulating on the inclined faces. Additionally, according to the evaluation executed by the inventors, a preferable result was attained by using a material having minute surface roughness in regular arrangement, such as Configuration 4 illustrated in FIG. 18B.

Regarding the surface roughness Ra with the measurement length of 2 μm, measured by the scanning probe microscope, there is no theoretical upper limit of the range that is repellent to developer. However, if projections and recesses on the surface are too large in size, in practice, the measurement values are different from true roughness because the probe of the scanning probe microscope fails to follow the roughened surface. It is to be noted that the state where the surface roughness Ra with the measurement length of 2 μm is large means that amplitudes in the depth direction of projections and recesses are large. According to JIS, an applicable range of surface roughness Ra measured by scanning probe microscopes is 1 nm to 30 nm. Although the measurement length of 2 μm in the evaluation described here does not comply with JIS, the probe fails to follow the roughened surface similarly. Therefore, although the lower limit of the surface roughness Ra with the measurement length of 2 μm was set to 25 nm, the upper limit was not set.

As illustrated in FIG. 18A, typically the surface of the fresh toner particle Tf (initial toner) is rugged due to external additives on the surface thereof. In the evaluation after elapse of time, the toner is degraded to the degraded toner particle Td illustrated in FIG. 18B, and the external additives are liberated or buried. Then, the surface becomes smoother, thereby increasing the area of contact between the degraded toner particle Td and the components of the developing device 600. That is, the area of contact of the faces of the conveying screw and the guide face 57*a* with toner increases. Accordingly, the force of adhesion of degraded toner and the surface of the component increases, and developer is likely to be retained around the position of toner adhesion. Thus, firm adhesion of developer arises. According to the evaluation made by the inventors, even if the surfaces of the conveying screws and the guide face 57*a* were made of materials of high smoothness such as those according to Comparative examples 2 and 3, adhesion of developer was found in evaluation after elapse of time.

FIG. 19A is the surface shape of 2 $\mu m^2$ of fresh toner particle Tf illustrated in FIG. 18A, and FIGS. 19B through 19H are surface shape of 2 $\mu m^2$ of the surfaces in Table 1. The surfaces were observed by the scanning probe microscope (SPM). Comparative example 1 has relatively large projections and recess without minute surface roughness, and Comparative examples 2 and 3 are smooth entirely. By contrast, in Configurations 1 through 4 according to the embodiments, the number of minute projections and minute recesses is greater. The surface of fresh toner particle Tf has a large number of minute projections and minute recesses due to the additives, and the surface roughness is similar to those of Configurations 1 through 4 according to the embodiments.

Figure 20A:
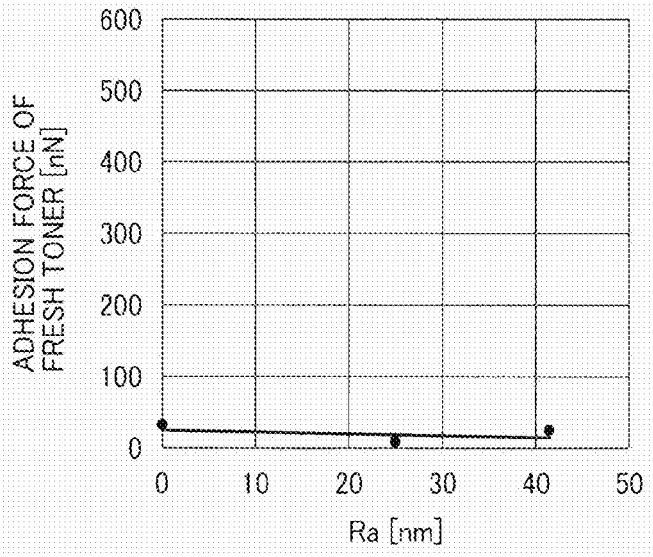
FIGS. 20A and 20B are graphs of the relation between adhesive force of toner and the surfaces in the evaluation in FIGS. 19B through 19H, and the surface roughness Ra by SPM measurement.
Figure 20B:
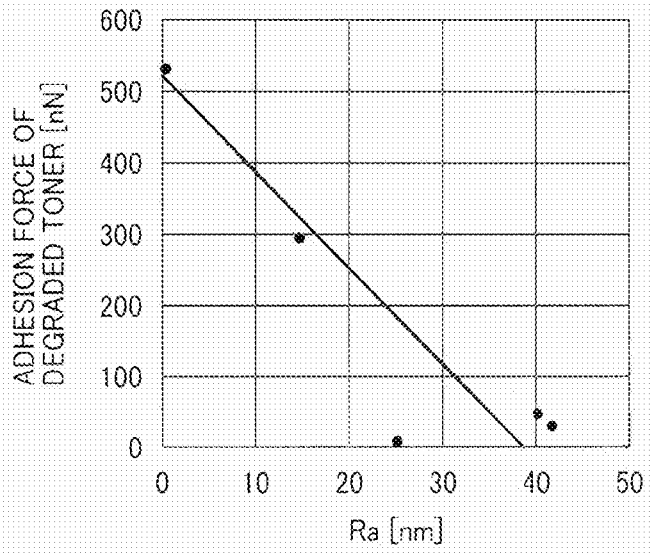

FIGS. 20A and 20B are graphs of the relation between the adhesive force of toner and the surface evaluated after elapse of time and the surface roughness Ra by SPM measurement. FIG. 20A concerns the fresh toner particle Tf, and FIG. 20B concerns the degraded toner particle Td.

It is to be noted that, the adhesive force was measured according to a method of measuring adhesion between toner and a substance by centrifugal separation, described in U.S. Pat. No. 6,284,424(B1), which is hereby incorporated by reference herein, and toner degraded by the above-described test run was used. As illustrated in FIGS. 20A and 20B, in the range of surface roughness Ra according to the embodiment, even in the case of degraded toner, the adhesive force is inhibited. Thus, use of surface having minute roughness is advantageous in inhibiting the area of contact of degraded toner with the component and keeping the adhesive force low. Thus, firm adhesion of degraded developer can be inhibited.

Additionally, adhesion of toner to the developer collecting device 700 (the collected-toner conveyance passage 590 in particular) is inhibited, which is effective in suppressing inconveniences caused by supply of a large amount of reused toner to the developing device after removal and installation of the process cartridge 650.

It is to be noted that, although the description above concerns evaluation using toner having a volume average particle diameter of 5.2 μm and an average circularity of 0.96, the state of contact between toner and the surface having the surface roughness defined in the present embodiment is similar to the case of toner having an average particle diameter of about 2 μm to about 10 μm. Thus, the features of the present embodiment are applicable to toner of such average particle diameter range. Additionally, although titanium oxide and silica are added to the toner used in the embodiments to improve flowability, additives are not limited thereto. As the additive, for example, inorganic particles may be caused to adhere or fixed on the surface of toner. The average particle diameter of inorganic particles is preferably from 10 nm to 200 nm. If the particle diameter is smaller than 10 nm, it is difficult to make the rough surface effective for flowability. If the particle diameter is greater than 200 nm, the particle shape becomes rough, causing inconveniences.

The inorganic particle usable in the embodiments include oxides and oxide composites of Si, Ti, Al, Mg, Ca, Sr, Ba, In, Ga, Ni, Mn, W, Fe, Co, Zn, Cr, Mo, Cu, Ag, V, Zr, and the like. Preferable materials among these are particles of silicon dioxide (silica), titanium dioxide (titania), and alumina. Additionally, making the surface of the inorganic particle hydrophobic by surface treatment is effective.

According to the first embodiment, firm adhesion of developer over time inside the developing device 5 can be inhibited since developer repellency is given to the surface of the component disposed inside the casing 50 of the developing device 5 and designed to contact developer, by providing the minute surface roughness to the portion to contact developer. Accordingly, even with degraded toner after elapse of time, the occurrence of image failure is inhibited, and it is not necessary to scrape off developer from the developer conveyor and the face defining the developer conveyance passage.

According to the second embodiment, in the configuration in which the cleaning device 514 collects developer from the image bearer, on which a visible image is formed with developer supplied by the developing device 600, and the collected developer is returned to the developing device 600 by the developer collecting device 700, developer repellency is given to the surface of the developer collecting device 700, designed to contact developer, by providing the surface roughness to the face to contact developer. Accordingly, adhesion of toner in the developer collecting device 700 is inhibited, which is effective in suppressing inconveniences caused by supply of reused toner to the developing device 600 in unintended manner.

The present invention is not limited to the details of the example embodiments described above, and various modifications and improvements are possible.

For example, although the second embodiment is described using the single-color copier, the second embodiment can adapt to other configurations. For example, the second embodiment can adapt to an image forming apparatus that includes multiple image bearers on which multiple color toners are formed, an intermediate transfer belt to which the toner images are transferred from the image bearers, a cleaning device to collect developer from the intermediate transfer belt, and a developer collecting device to return the developer collected from the intermediate transfer member to the developing device.

The image forming apparatus is not limited to monochrome and multicolor copiers. Alternatively, the image forming apparatus may be a printer, a facsimile machine, or a multifunction device (MFP) having a plurality of capabilities.

Additionally, effects of the embodiments mentioned above are examples of preferable effects, and effects attained by various aspects of this specification are not limited thereto.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device, comprising:

a casing configured to contain developer;

a developer conveyer disposed in the casing and configured to transport the developer through a developer conveyance passage formed in the casing; and a developer bearer disposed in the casing and configured to bear the developer, wherein at least one of the developer conveyer and the developer conveyance passage has a rough surface repellent to the developer having a surface roughness Ra uniform in a direction in which the developer is transported, the casing comprises a developer collecting compartment configured to collect the developer transported from the developer bearer, a developer supply compartment positioned below the developer collecting compartment and configured such that the developer is supplied from the developer supply compartment to the developer bearer, and a partition separating the developer supply compartment from the developer collecting compartment, the developing device comprises a first developer conveyor disposed in the developer collecting compartment and a second developer conveyor disposed in the developer supply compartment, the partition comprises a plurality of communicating portions formed at both longitudinal ends of the developer collecting compartment and the developer supply compartment such that the developer is circulated between the developer collecting compartment and the developer supply compartment through the communicating portions, and a guide face facing the developer collecting compartment, configured to guide the developer from the developer bearer to the developer collecting compartment, and having the rough surface repellent to the developer, and the surface roughness Ra is greater than 25 nm when measured by a scanning probe microscope in a measurement length of 2 μm, and is smaller than 5 μm when measured by a contact-type surface roughness meter according to ES B0601:'01.

2. The developing device according to claim 1, wherein the rough surface of the at least one of the developer conveyer and the developer conveyance passage has projections and recesses in regular arrangement.

3. The developing device according to claim 1, wherein at least one of the first developer conveyor and the second developer conveyor has the rough surface repellent to the developer.

4. The developing device according to claim 1, wherein the casing comprises the developer collecting compartment, the developer supply compartment, and the partition such that the casing has a first developer-containing compartment, a second developer-containing compartment, and an opening, that the first and second developer-containing compartments communicate with each other at the opening, that the first developer conveyor is disposed in the first developer-containing compartment, and that the second developer conveyor is disposed in the second developer-containing compartment, the first developer conveyor and the second developer conveyor are configured to circulate the developer between the first and second developer-containing compartments, and at least one of the first developer conveyor and the second developer conveyor has the rough surface repellent to the developer.

5. The developing device according to claim 1, wherein an area of a surface of the partition facing the developer collecting compartment between two lines tangential to an outline of the first developer conveyor extending vertically from the outline of the first developer conveyor does not have the rough surface.

6. The developing device according to claim 1, wherein a surface of the partition facing the developer collecting compartment is flat, and the rough surface of the guide face of the partition is formed by applying a repellent coating or a repellent sheet to the surface of the partition facing the developer collecting compartment.

7. A process cartridge, comprising:

the developing device according to claim 1; and at least one of an image bearer, a charging device configured to charge the image bearer, and a cleaning device configured to clean the image bearer, wherein the process cartridge is removably installable in an image forming apparatus.

8. An image forming apparatus, comprising the process cartridge according to claim 7.

9. An image forming apparatus, comprising the developing device according to claim 1.

10. An image forming apparatus, comprising:

an image bearer configured to bear a latent image;

the developing device according to claim 1;

a cleaning device configured to collect the developer transported from the image bearer; and a developer collecting device configured to return the developer collected by the cleaning device to the developing device, wherein an inner surface of the developer collecting device has a rough surface repellent to the developer having a surface roughness Ra uniform in a direction in which the developer is transported, and the surface roughness Ra is greater than 25 nm when measured by a scanning probe microscope in a measurement length of 2 μm, and is smaller than 5 μm when measured by a contact-type surface roughness meter according to JIS B060 1:'01.

11. The image forming apparatus according to claim 10, wherein the developer collecting device comprises a collected-developer conveyor configured to transport the developer collected by the cleaning device through a collected-developer conveyance passage connecting the developer collecting device to the cleaning device and the developing device, and at least one of the collected-developer conveyor and the collected-developer conveyance passage has the rough surface repellent to the developer.

12. A developing device, comprising:

a casing configured to contain developer;

a developer conveyer disposed in the casing and configured to transport the developer through a developer conveyance passage formed in the casing; and a developer bearer disposed in the casing and configured to bear the developer, wherein the casing comprises a developer collecting compartment configured to collect the developer transported from the developer bearer, a developer supply compartment configured such that the developer is supplied from the developer supply compartment to the developer bearer, a developer conveyance compartment connecting a downstream end of the developer collecting compartment and an upstream end of the developer supply compartment, and a plurality of communicating portions formed at longitudinal ends of the developer collecting compartment, the developer supply compartment, and the developer conveyance compartment such that the developer is circulated in the developer collecting compartment, the developer supply compartment, and the developer conveyance compartment through the communicating portions, the developing device comprises a first developer conveyor disposed in the developer collecting compartment, a second developer conveyer disposed in the developer supply compartment, and a third developer conveyor disposed in the developer conveyance compartment, and at least one of the first developer conveyor, the second developer conveyor, and the third developer conveyor has a rough surface repellent to the developer.

13. The developing device according to claim 12, wherein the rough surface of the at least one of the developer conveyer and the developer conveyance passage has projections and recesses in regular arrangement.

14. The developing device according to claim 12, wherein the rough surface has a surface roughness Ra which is greater than 25 nm when measured by a scanning probe microscope in a measurement length of 2 μm, and is smaller than 5 μm when measured by a contact-type surface roughness meter according to JIS B0601:'01.

15. A process cartridge, comprising:

the developing device according to claim 2; and at least one of an image bearer, a charging device configured to charge the image bearer, and a cleaning device configured to clean the image bearer, wherein the process cartridge is removably installable in an image forming apparatus.

16. A process cartridge, comprising:

the developing device according to claim 12; and at least one of an image bearer, a charging device configured to charge the image bearer, and a cleaning device configured to clean the image bearer, wherein the process cartridge is removably installable in an image forming apparatus.

17. The developing device according to claim 1, wherein the developer comprises a carrier and a toner, and the toner has an average particle diameter of from 2 μm to 10 μm.

18. The developing device according to claim 12, wherein the developer comprises a carrier and a toner, and the toner has an average particle diameter of from 2 μm to 10 μm.

* * * * *